US007370857B2

(12) United States Patent
Otsuki

(10) Patent No.: US 7,370,857 B2
(45) Date of Patent: May 13, 2008

(54) PAPER FEEDING APPARATUS

(75) Inventor: Noboru Otsuki, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 404 days.

(21) Appl. No.: 10/834,366

(22) Filed: Apr. 29, 2004

(65) Prior Publication Data

US 2005/0001371 A1 Jan. 6, 2005

(30) Foreign Application Priority Data

May 2, 2003 (JP) ..... P. 2003-127313
May 16, 2003 (JP) ..... P. 2003-139210

(51) Int. Cl.
*B65H 3/06* (2006.01)

(52) U.S. Cl. ..... 271/114; 271/115; 271/117

(58) Field of Classification Search ..... 271/117, 271/118, 114, 115
See application file for complete search history.

(56) References Cited

U.S. PATENT DOCUMENTS

| | | | | |
|---|---|---|---|---|
| 4,934,686 | A * | 6/1990 | Ono et al. | 271/117 |
| 5,527,026 | A | 6/1996 | Padget et al. | |
| 5,868,385 | A * | 2/1999 | Embry et al. | 271/118 |
| 5,895,040 | A | 4/1999 | Oleksa et al. | |
| 6,352,256 | B1 * | 3/2002 | Hsieh | 271/110 |
| 7,059,596 | B2 * | 6/2006 | Iwase | 271/114 |
| 7,093,830 | B2 * | 8/2006 | Kang | 271/118 |

FOREIGN PATENT DOCUMENTS

| | | |
|---|---|---|
| EP | 0 320 246 | 6/1989 |
| EP | 0 732 281 | 9/1996 |
| EP | 0 885 825 | 12/1998 |
| EP | 1 125 873 | 8/2001 |
| JP | 49-25326 | 7/1974 |
| JP | 64-072872 | 3/1989 |
| JP | 1-156241 | 6/1989 |
| JP | 1-197237 | 8/1989 |
| JP | 04-179635 | 6/1992 |
| JP | 05-000738 | 1/1993 |
| JP | 05-201556 | 8/1993 |
| JP | 05-286595 | 11/1993 |
| JP | 7-117866 | 5/1995 |
| JP | 8-259013 | 10/1996 |
| JP | 09-240868 | 9/1997 |
| JP | 11-11719 | 1/1999 |
| JP | 11-334922 | 12/1999 |
| JP | 2000-177859 | 6/2000 |
| JP | 2001-080777 | 3/2001 |

(Continued)

*Primary Examiner*—David H Bollinger
(74) *Attorney, Agent, or Firm*—Nixon & Vanderhye P.C.

(57) ABSTRACT

A paper feeding apparatus includes a housing accommodating a plurality of papers, a pickup unit, a rotation transmitting member and a torque transmitting member. The pickup unit has a pickup lever, a driving shaft rotatably supporting the pickup lever, and a pickup roller rotatably provided on an end of the pickup lever. The rotation transmitting member transmits a rotating force of the driving shaft to the pickup roller. The torque transmitting member is provided between the driving shaft and the pickup lever. The torque transmitting member selectively rotates one of the pickup lever or the pickup roller depending on a torque acting on the driving shaft. The pickup roller is rotated while being pressed against the papers, thereby feeding the papers one by one out of the housing.

22 Claims, 22 Drawing Sheets

FOREIGN PATENT DOCUMENTS

| | | |
|---|---|---|
| JP | 2001-097574 | 4/2001 |
| JP | 2001-106345 | 4/2001 |
| JP | 2001-302006 | 10/2001 |
| JP | 2002-104682 | 4/2002 |
| JP | 2002-154667 | 5/2002 |
| JP | 2002-167062 | 6/2002 |
| JP | 2002-211767 | 7/2002 |
| JP | 2003-012175 | 1/2003 |

* cited by examiner

PAPER FEEDING APPARATUS

BACKGROUND OF THE INVENTION

The present invention relates to a paper feeding apparatus for a printer.

Currently, there have been used paper feeding apparatuses for printers which have various configurations. For example, as shown in FIG. 21, there has been known a paper feeding apparatus in which a pickup roller 202 is rotatably provided on the rocking tip side of a pickup lever 201. The pickup lever 201 has a base end side supported rotatably on a housing. The pickup roller 202 is rotated to feed paper where a rolling contact surface (rubber lining surface) of the pickup roller 202 is pressed against a top paper or sheet S of a paper bundle accommodated and held on a paper guide wall 203 by the rotation of the pickup lever 201.

In a paper feeding apparatus of this type, the pickup roller 202 is urged in the direction of the paper bundle by a spring, which is not shown, and the pressing force of the pickup roller 202 against the paper bundle is set by the spring force of the spring.

In the paper feeding apparatus of this type, moreover, when the paper S is gone and the rolling contact surface of the pickup roller 202 comes in contact with the paper guide wall 203 as shown in FIG. 22, a large frictional force is generated between the pickup roller 202 rotating in a paper feeding direction (a direction of an arrow A) and the paper guide wall 203. By the frictional force, a force for moving in an opposite direction (a direction of an arrow F) to the paper feeding direction is generated on the pickup roller 202, and there is a possibility that the pickup roller 202 might be locked.

In order to avoid locking the pickup roller 202, there has been proposed a paper feeding apparatus which prevents an unnecessary frictional force from being generated. In the paper feeding apparatus, as shown in FIG. 23, a free rotating roller 205 urged by a spring 204 is provided in the paper guide wall 203 opposed to the pickup roller 202. When the paper S is gone, the rolling contact surface of the pickup roller 202 is pushed against the peripheral surface of the free rotating roller 205 so that the pickup roller 202 is rotated together with the free rotating roller 205. As a result, the pickup roller 202 can be thus prevented from being locked (for example, see JP-A-8-259013).

When a pressing force against the paper bundle of a pickup roller is set by a spring force, however, there is a problem in that the pressing force of the pickup roller becomes large when unused paper is pulled out, and it becomes difficult to remove the paper. More specifically, in some cases when the pressing force of the pickup roller against the paper bundle is too great, the pressing force of the pickup roller is greater than a force for feeding the paper by the rotation of the pickup roller so that the pickup roller is locked and the paper cannot be fed out.

Moreover, the amount of flexure of the spring is changed in accordance with the thickness of the paper bundle. For this reason, there is also a problem in that a force for pressing the paper bundle by the roller is changed. For example, when the number of the papers is large, the amount of contraction of the spring is large. Therefore, the spring force is increased so that the pressing force of the roller is increased. On the other hand, when the number of the papers is small, the amount of the contraction of the spring is small, and the spring force is reduced so that the pressing force of the roller is decreased.

As in the paper feeding apparatus described in JP-A-8-259013, moreover, when the free rotating roller 205 urged by the spring 204 is opposed to the pickup roller 202 in the paper guide wall 203, when a second paper S(2) from the last is fed as shown in FIG. 24, the last paper S(1) is held on the paper guide wall 203 side with difficulty since the last paper S(1) comes in contact with the free rotating roller 205 and is thus urged toward the pickup roller 202. As a result, there is a possibility that a so-called "double feed" might occur, that is, two sheets might be fed together.

Also, with the free rotating roller 205 and the spring 204, the number of components is increased.

SUMMARY OF THE INVENTION

In consideration of the circumstances, it is a first object of the invention to provide a paper feeding apparatus capable of pushing a roller against a paper bundle by a stable pressing force irrespective of the number of papers.

Moreover, it is a second object of the invention to provide an excellent paper feeding apparatus capable of preventing a double feed when feeding a second to last paper while avoiding locking of a pickup roller without paper, and furthermore, suppressing an increase in the number of components.

The objects of the invention can be achieved by the following structures.

(1) A paper feeding apparatus, comprising:
- a housing accommodating a plurality of papers;
- a pickup unit including:
  - a pickup lever;
  - a driving shaft rotatably supporting the pickup lever;
  - a pickup roller rotatably provided on an end of the pickup lever; and
  - a rotation transmitting member transmitting a rotating force of the driving shaft to the pickup roller; and
- a torque transmitting member, provided between the driving shaft and the pickup lever, the torque transmitting member selectively rotating one of the pickup lever or the pickup roller depending on a torque acting on the driving shaft,
- wherein the pickup roller is rotated while being pressed against the papers, thereby feeding the papers one by one.

(2) The paper feeding apparatus according to (1), wherein the torque transmitting member is configured such that when the torque is smaller than a predetermined value, the pickup lever is rotated with the driving shaft; and
- such that when the torque is equal to or greater than the predetermined value, the pickup roller is rotated with the driving shaft.

(3) The paper feeding apparatus according to (1), wherein the torque transmitting member rotates the pickup lever in conjunction with the driving shaft in accordance with a first rotation direction of the driving shaft so that the pickup roller is pressed against the paper.

(4) The paper feeding apparatus according to (3), wherein the torque transmitting member rotates the pickup lever in conjunction with the driving shaft in accordance with a second rotation direction of the driving shaft so that the pickup roller is moved to a standby position away from the paper.

(5) The paper feeding apparatus according to (2), wherein the pickup lever has a hook receiving portion;
- wherein the torque transmitting member has a hook portion to be engaged with the hook receiving portion, and has a spring drum portion to be engaged frictionally with an outer face of the driving shaft; and wherein the predetermined value is set by a frictional engaging force of the spring drum portion.

(6) The paper feeding apparatus according to (1), further comprising a cleaning member, cleaning a peripheral face of the pickup roller by rotating the pickup roller.

(7) The paper feeding apparatus according to (6), wherein the peripheral face of the pickup roller is positioned so as to be rubbed against the cleaning member when the pickup roller is positioned at a standby position away from the paper.

(8) The paper feeding apparatus according to (6), wherein a cleaning operation of the pickup roller by the cleaning member is executed after the paper is fed by the pickup roller.

(9) The paper feeding apparatus according to any of (2), wherein the predetermined value of the torque is varied depending on a driving shaft rotation direction.

(10) The paper feeding apparatus according to (1), further comprising:

a movable plate provided in the housing;

a first friction member provided on the movable plate and on which lower ends of the papers accommodated in the housing abut; and an urging member urging the movable plate in a direction opposite from a paper feeding direction.

(11) The paper feeding apparatus according to (10), wherein the movable plate is pressed and tilted by the paper which is fed out by the pickup roller.

(12) The paper feeding apparatus according to (10), wherein the housing has an opening which is disposed on an extension of a paper feeding path toward a paper supply destination, and which allows feeding of the paper through an underside of the movable plate.

(13) The paper feeding apparatus according to (1), wherein the housing comprises a paper guide wall that supports and guides the papers, and wherein a relief hole for avoiding an interference with the pickup roller is provided in a portion of the paper guide wall opposed to the pickup roller;

wherein a second friction member, having a friction resistance higher than that of the paper guide wall and lower than that of the pickup roller, is provided on the paper guide wall disposed around the relief hole; and wherein an engaging mechanism is disposed between the pickup lever and the housing, the engaging mechanism regulating a pivoting position of the pickup roller to prevent contact with the paper guide wall when the pickup roller is inserted into the relief hole.

(14) The paper feeding apparatus according to (13), wherein a first friction member is provided below the relief hole.

(15) The paper feeding apparatus according to (13), wherein the engaging mechanism has a low friction rotating portion provided in the pickup roller; and wherein the low friction rotating portion rotates in contact with the engaging mechanism.

(16) A paper feeding apparatus, comprising:

a housing accommodating a plurality of papers;

a pickup lever; and a pickup roller rotatably provided on an end of the pickup lever, the pickup roller rotating a contact surface thereof pressed against the papers to feed the papers one by one, wherein the housing comprises a paper guide wall that supports and guides the papers, and wherein a relief hole for avoiding an interference with the contact surface is provided a portion of the paper guide wall opposed to the pickup roller; and wherein an engaging mechanism is disposed between the pickup lever and the housing, the engaging mechanism regulating a pivoting position of the pickup roller to prevent contact with the paper guide wall when the rolling contact surface is inserted into the relief hole.

(17) The paper feeding apparatus according to (16), wherein the engaging mechanism has a low friction rotating portion provided in the pickup roller; and wherein the low friction rotating portion rotates in contact with the engaging mechanism.

(18) The paper feeding apparatus according to (16), wherein a friction member having a friction resistance higher than that of the paper guide wall and lower than that of the contact surface, is provided on the paper guide wall disposed around the relief hole.

(19). A method of feeding papers one by one to a sheet outlet of a paper housing, the method comprising:

supporting a plurality of papers in the paper housing;

selectively engaging a pickup unit with the papers, the pickup unit including a pickup lever, a driving shaft, a pickup roller, and a rotation transmitting member;

transmitting a rotating force of the driving shaft to the pickup roller with the rotation transmitting member;

selectively rotating one of the pickup lever or the pickup roller via a torque transmitting member depending on a torque acting on the driving shaft; and feeding the papers one by one from the housing to the sheet outlet by rotating the pickup roller while being pressed against the papers.

(20). The method according to (19), wherein when the torque is smaller than a predetermined value, the method comprising rotating the pickup lever with the driving shaft, and wherein when the torque is equal to or greater than the predetermined value, the method comprising rotating the pickup roller with the driving shaft.

In the paper feeding apparatus according to the invention, the pickup lever is provided with the driving shaft to be rotated and driven by a motor. The driving shaft and the pickup roller are interlocked with each other by the rotation transmitting member. The torque transmitting member is provided between the driving shaft and the pickup lever. The torque transmitting member engages the driving shaft and the pickup lever to freely transmit a torque until a predetermined torque or more acts on the driving shaft, and releases the driving shaft and the pickup lever to permit the rotation of the driving shaft with respect to the pickup lever.

According to the invention, the driving shaft rotation direction in feeding the paper by the pickup roller is coincident with the driving shaft rotation direction in rotating of the pickup lever toward the paper bundle side through the torque transmitting member. Therefore, the rotating torque of the motor rotates the pickup lever to press the pickup roller onto the paper, and the pickup roller is rotated to feed out the paper using the torque having the predetermined value or more when the same torque acts after the pickup roller is pressed against the paper bundle. Accordingly, it is possible to feed the paper in a state that the pickup roller is pressed against the paper bundle by a stable pressing force irrespective of the number of papers and to enhance the removing property of the paper.

According to the invention, the paper feeding apparatus includes the housing having a back cover for accommodating and holding the paper bundle in an oblique erecting posture. A pickup roller to be pressed against the paper in the uppermost portion of the paper bundle serves to feed the paper by its own rotation while moving downward. A movable plate provided in the lower part of the back cover serves to separate the paper to be fed out and supports a lower end of the paper bundle accommodated and held in the back cover. The movable plate is rotatably supported by a shaft provided on the back cover side of the movable plate. Consequently, an extended portion extended in the paper feeding direction can be tilted in a vertical direction while being urged upward by a spring, and it is thus possible to exhibit excellent separating performance irrespective of the rigidity of the paper.

According to the paper feeding apparatus of the invention, a relief hole for avoiding interference with the rolling contact surface is provided in the paper guide wall opposed to the rolling contact surface of the pickup roller, and contact with the paper guide wall can be prevented by the engaging mechanism when the rolling contact surface enters the relief hole.

Also when the paper is gone from the paper guide wall, the rolling contact surface of the pickup roller enters the relief hole and contact with the paper guide wall is prevented, and the same rolling contact surface does not directly hit against the paper guide wall. Consequently, it is possible to prevent the pickup roller from being locked.

When a second to last paper is fed, the last paper is held by the second friction member provided around the relief hole. Therefore, a double feed is avoided.

Furthermore, the relief hole is provided on the paper guide wall and the second friction member is simply provided therearound. As compared with the case in which the free rotating roller and the spring are provided, therefore, it is possible to suppress an increase in the number of components. Thus, it is possible to prevent manufacturing costs from being increased.

BRIEF DESCRIPTION OF THE DRAWINGS

The above objects and advantages of the present invention will become more apparent by describing in detail preferred exemplary embodiments thereof with reference to the accompanying drawings, wherein: with reference to the accompanying drawings, wherein.

DETAILED DESCRIPTION OF THE PREFERRED EMBODIMENTS

First Embodiment

A paper feeding apparatus according to a embodiment of the invention will be described below in detail with reference to the accompanying drawings.

Figure 1:
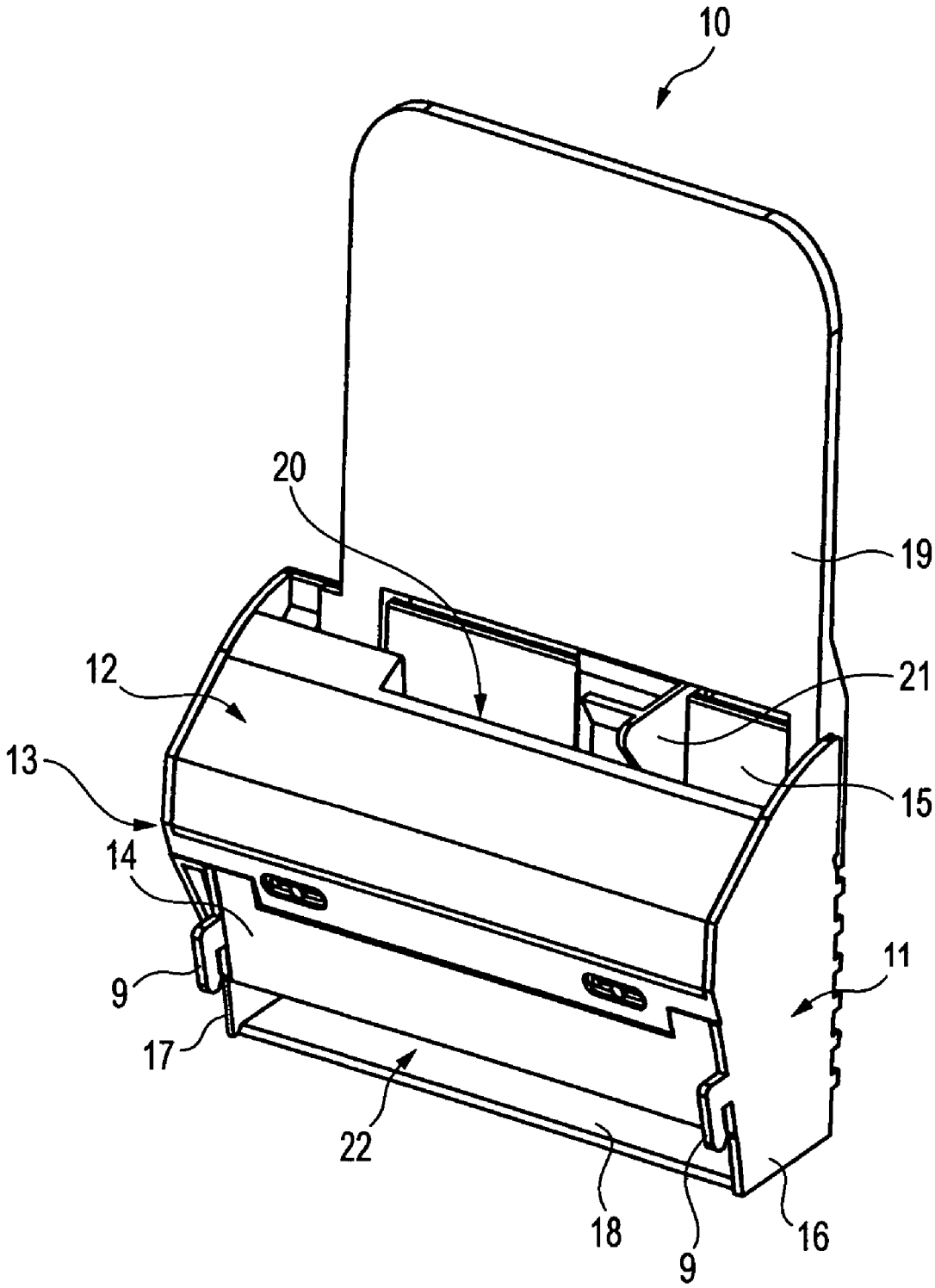
FIG. 1 is a perspective view showing the appearance of a paper feeding apparatus according to an embodiment of the invention.
Figure 2:
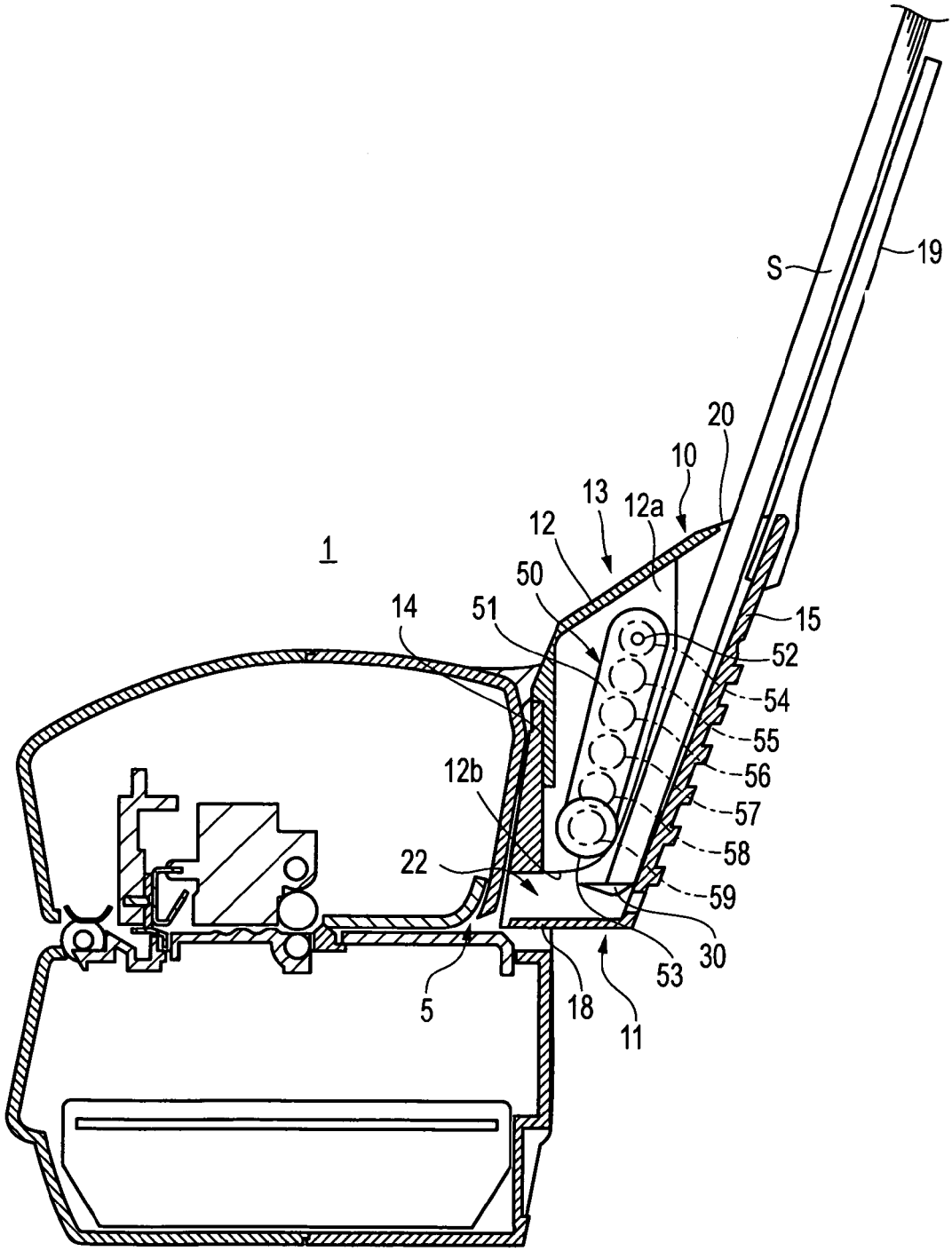
FIG. 2 is a sectional side view showing a state in which the paper feeding apparatus of FIG. 1 is attached to a printer body portion 1.
Figure 3:
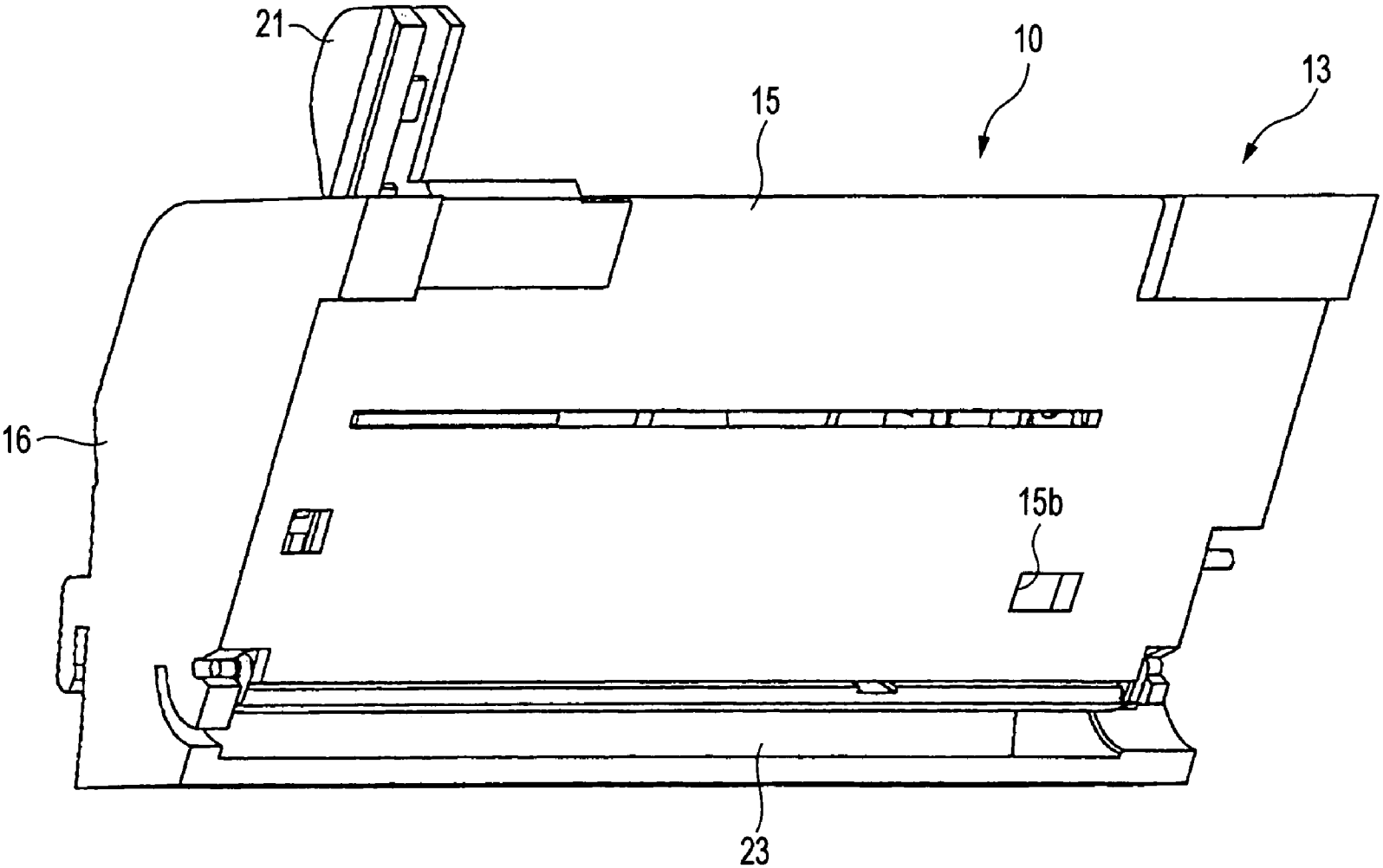
FIG. 3 is a perspective view showing the paper feeding apparatus as seen from a back side.

FIG. 1 is a perspective view showing the appearance of the paper feeding apparatus according to the embodiment which is to be attached to a printer body portion, FIG. 2 is a sectional side view showing a state in which the paper feeding apparatus illustrated in FIG. 1 is attached to the printer body portion, and FIG. 3 is a perspective view showing the paper feeding apparatus illustrated in FIG. 1 as seen from a back side.

A paper feeding apparatus 10 according to the embodiment is an ASF (automatic sheet feeder) capable of accommodating a plurality of papers (cut-form papers) having a predetermined size and feeding the papers one by one into a printer body portion 1.

The paper feeding apparatus 10 is mainly constituted by a housing 13 including a lower case 11 and an upper cover 12. The lower case 11 is a box member formed integrally by a resin which has a front cover 14, a back cover 15 constituting a paper guide wall, right and left side covers 16 and 17, and a bottom cover 18. As shown in FIG. 2, paper S is superposed on a paper guide surface 15*a* of the back cover 15 in an oblique erecting posture, and is thus accommodated and held.

An upper opening 20 constituted by the front cover 14, the side covers 16 and 17, and the back cover 15 is provided on the upper surface side of the lower case 11. The upper cover 12 is inserted from the upper opening 20 and is fitted in the lower case 11 in order to block a part of the upper opening 20. A portion which is not blocked with the upper opening 20 is constituted as a paper inserting port through which paper S is inserted obliquely.

The side covers 16 and 17 are provided with hook portions 9 for attaching the paper feeding apparatus 10 to the printer body portion 1. The hook portions 9 are inverse L-shaped, are protruded toward the opposite side of the back cover 15 and are bulged downward, for example, and are caught on engagement holes (not shown) in the back face portion of the printer body portion 1 so that the paper feeding apparatus 10 is detachably fixed to the printer body portion 1.

A plane-shaped paper guide 19 for supporting paper in a portion positioned above the back cover 15, and a paper guide member 21 for inserting and guiding the paper S inserted through the upper opening 20 are provided on the upper end of the back cover 15.

The paper guide member 21 is constituted slidably along the upper end of the back cover 15. A width between the paper guide member 21 and the side cover 17 is set almost equal to the width of the paper S to be inserted so that both ends of the paper S are guided by the side cover 17 and the paper guide member 21 so that the paper S can be inserted without inclination in a transverse direction.

As shown in FIG. 2, a movable plate 30 having an upper surface against which the lower end of the paper S is pressed is provided at the inside of the lower part of the back cover 15 of the lower case 11. The movable plate 30 is rotatably provided so as to vary an inclination angle with respect to the back cover 15. The movable plate 30 will be described later in detail.

A lower opening 22 constituted by the front cover 14, the side covers 16 and 17, and the bottom cover 18 is provided on the bottom face side of the lower case 11. The lower opening 22 constitutes a paper discharge port for discharging the paper S inserted from the upper opening 20 and defines a paper inserting port toward a paper feeding path 5 of the printer body portion 1. As shown in FIG. 3, moreover, a slit-shaped opening 23 for manually inserting the paper S and discharging the rear end of the paper S outside of the apparatus in the beginning of the feed of the paper S is provided on the lower end of the back cover 15.

An attachment rib 12*a* formed integrally with the upper cover 12 is provided on the inside of the upper cover 12 (the back cover 15 side). The attachment rib 12*a* has a guide end 12*b* provided in the direction of insertion of the paper S. The guide end 12*b* of the attachment rib 12*a* positions the paper S inserted from the upper opening 20 together with the back cover 15, and guides the paper S to be discharged from the opening 22 as the paper discharge port. A pickup unit 50 for paper feeding is fixed to the attachment rib 12*a*.

Figure 4:
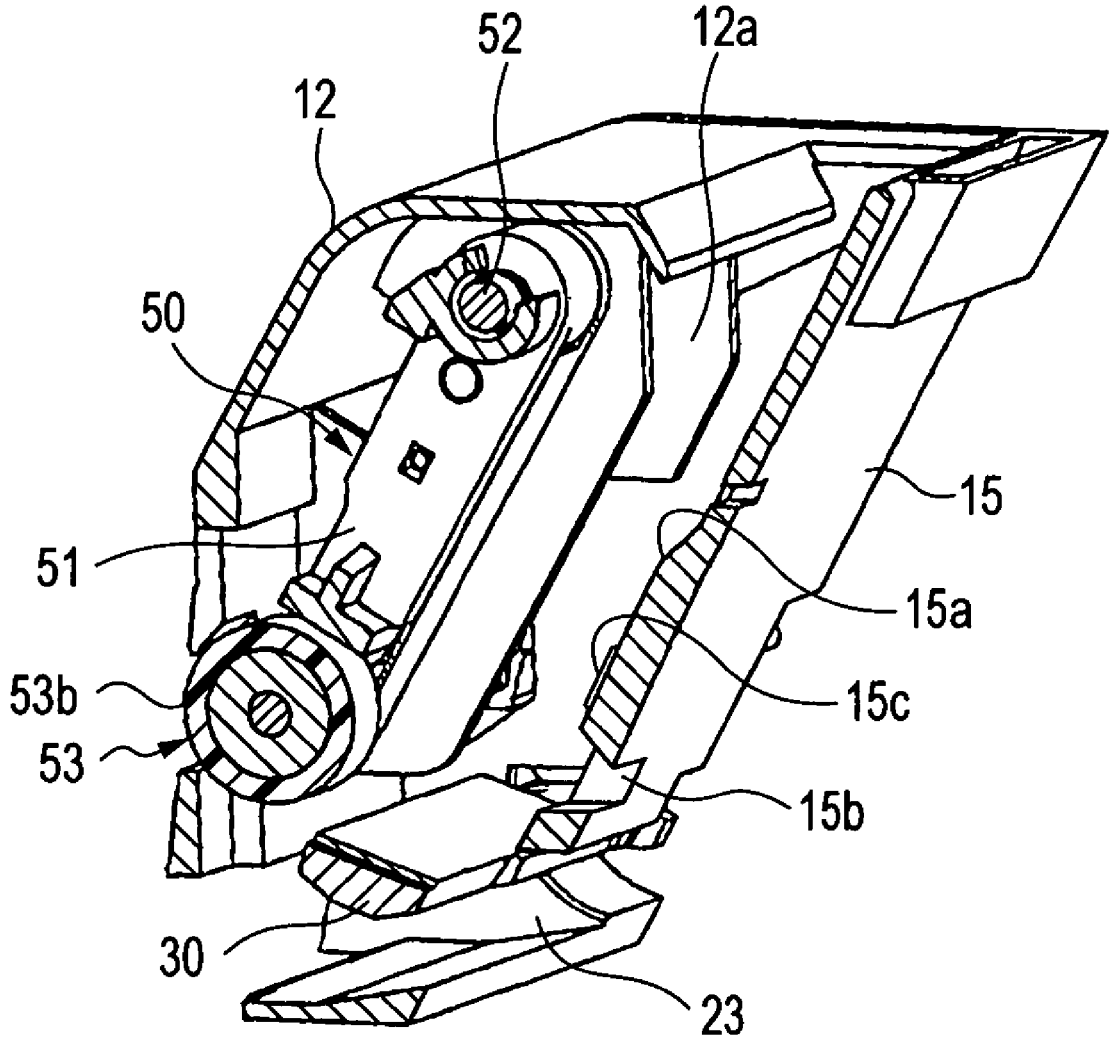
FIG. 4 is a view showing the paper feeding apparatus seen from an oblique back side, a portion provided with a pickup unit being cut away.
Figure 5:
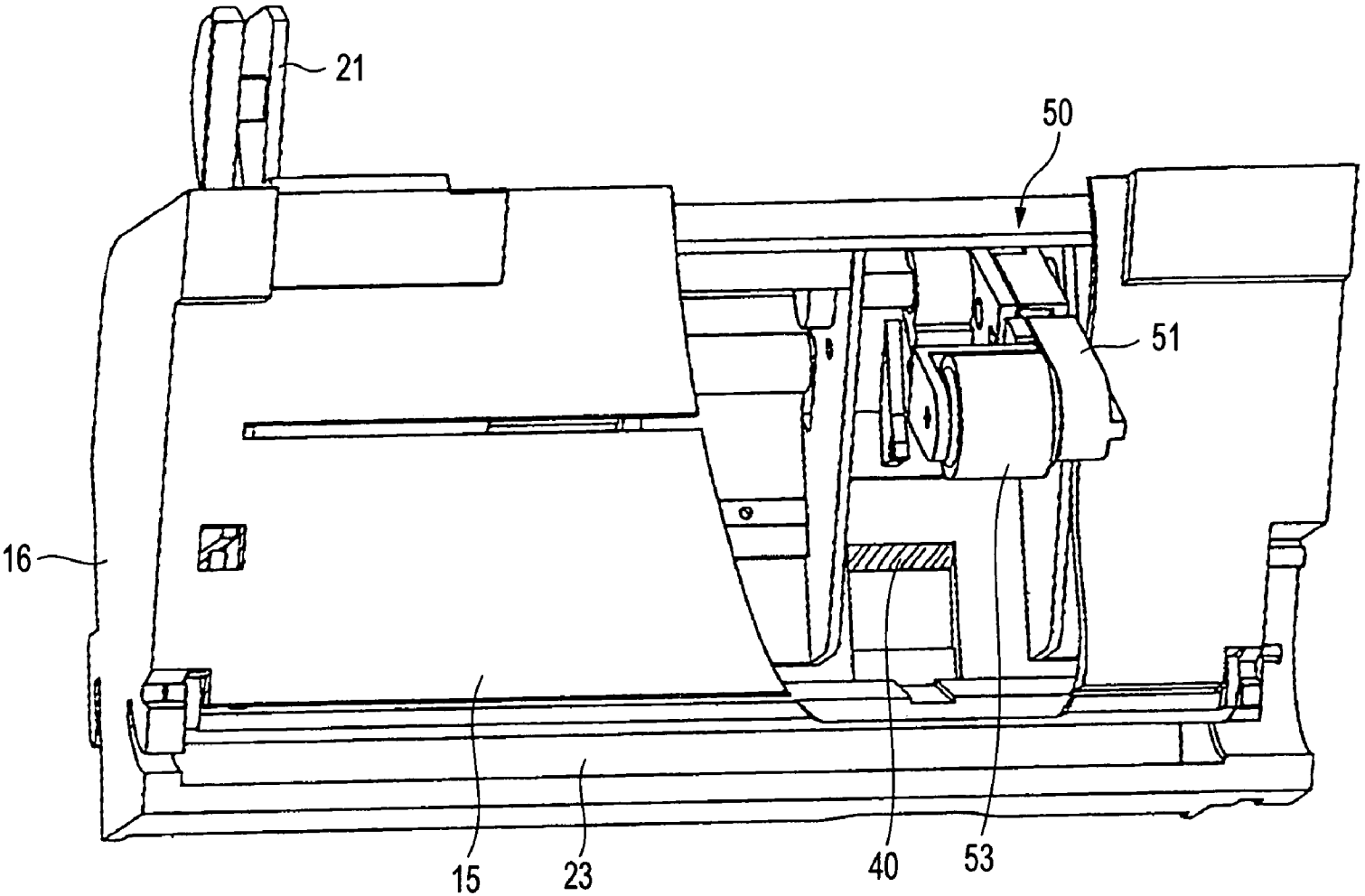
FIG. 5 is a view showing only the portion provided with the pickup unit in the paper feeding apparatus as seen from an oblique back side, a back cover being taken away.
Figure 6:
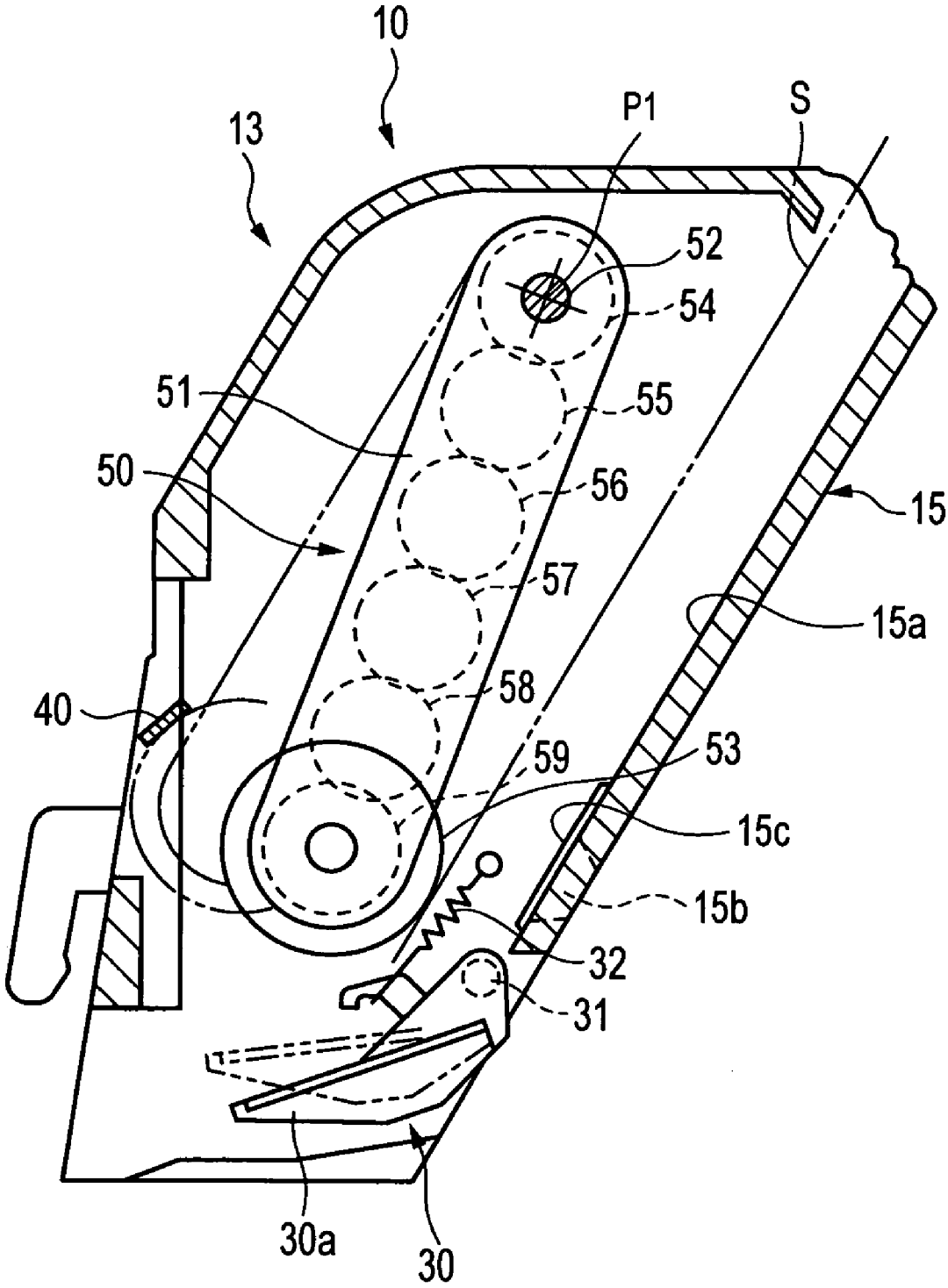
FIG. 6 is a side view schematically showing the relationship between the pickup unit and a friction pad.

FIG. 4 is a view seen from an oblique back side, showing a portion provided with the pickup unit 50 which is cut away. FIG. 4 shows a state in which the pickup unit 50 is placed in a standby position. Moreover, FIG. 5 is a view seen from an oblique back side, showing the back cover 15 which is cut away in only the portion provided with the pickup unit 50. FIG. 5 shows the pickup unit 50 which is floated from the standby position. FIG. 6 is a sectional view conceptionally showing the positional relationship between the pickup unit 50 and movable plate 30 and the other members, FIG. 7 is a perspective view showing the pickup unit 50, FIG. 8 is a side view showing the pickup unit 50, and FIG. 9 is an explanatory view showing a clutch spring 60 (a torque transmitting member) attached to the driving shaft of the pickup unit 50.

Figure 7:
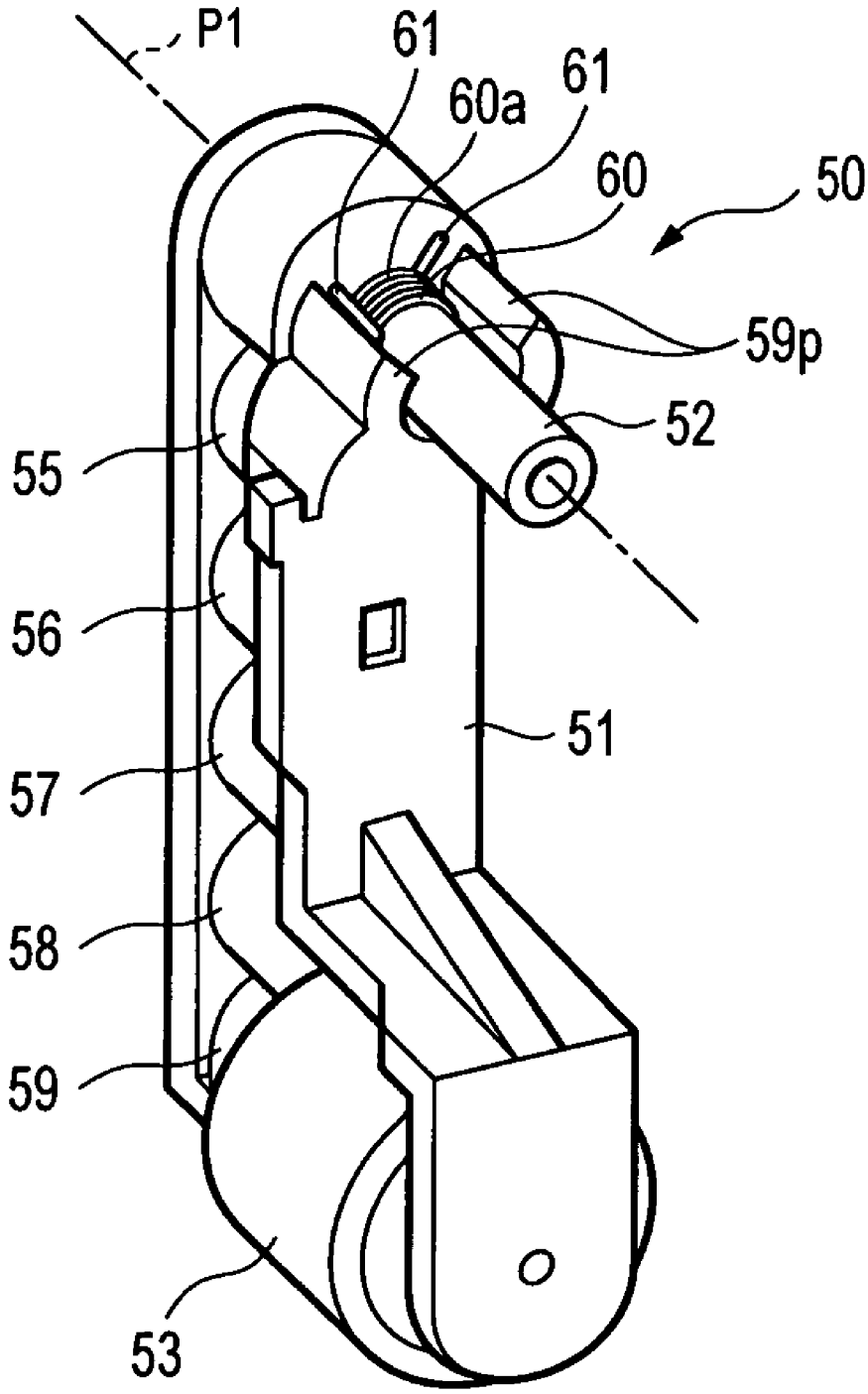
FIG. 7 is a perspective view showing only the pickup unit.
Figure 8:
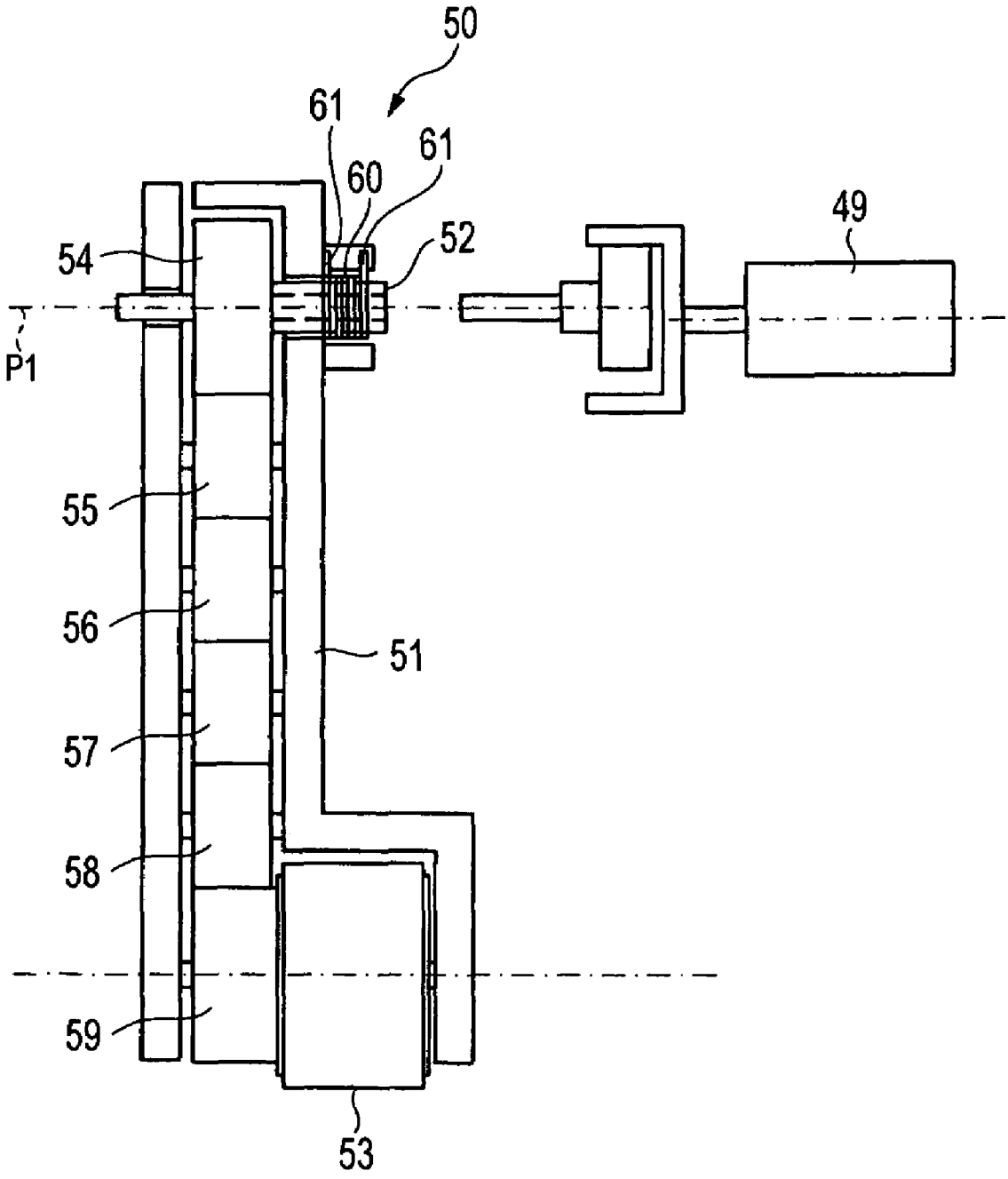
FIG. 8 is a side view showing the pickup unit.
Figure 9:
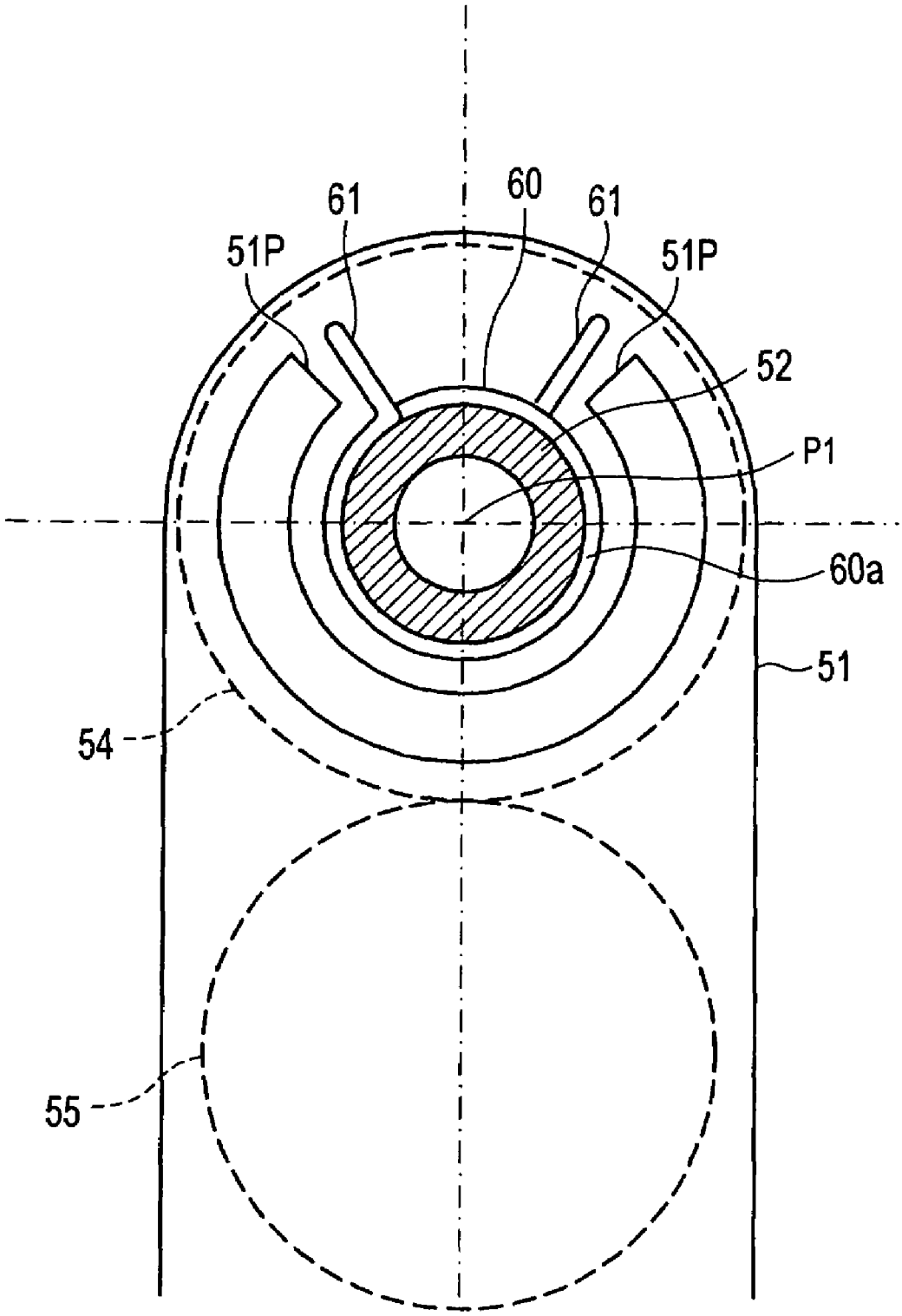
FIG. 9 is an explanatory view showing a torque transmitting member (a clutch spring 60) attached to the driving shaft of the pickup unit.

As shown in FIG. 6, 7 or 8, the pickup unit 50 includes a pickup lever 51, a driving shaft 52 to be driven by a motor 49 (which is shown in only FIG. 8), a pickup roller 53 for feeding the paper S toward the printer body portion 1 by pressing its peripheral surface against the paper S, and gears (rotation transmitting members) 54 to 59 which transmit a rotation driving force between the driving shaft 52 and the pickup roller 53 and are sequentially engaged. The gear 54 at an input stage is integrated with the driving shaft 52 and the gear 59 at an output stage is integrated with the pickup roller 53.

The pickup roller 53 has a rolling contact surface 53*b* formed by wrapping a high friction material such as rubber lining around the outer periphery of a core member such as a plastic. Low friction rotating members 53*a* having a diameter smaller than the diameter of the rolling contact surface 53*b* are provided on both end sides of the pickup roller 53 in the axial direction of the pickup roller 53.

The low friction rotating member 53*a* according to the embodiment is formed by leaving the peripheral surface of the core member without wrapping the high friction material. The low friction rotating member 53*a* has a surface which is more slidable than the rolling contact surface 53*b*. The low friction rotating member 53*a* can abut, with slipping, on the back cover 15 provided around a relief hole 15*b* which will be described below, and constitutes an engaging mechanism which will be described below.

As shown in FIG. 4, the pickup lever 51 has an upper end side (a base end side) supported rotatably on the attachment rib 12*a* of the upper cover 12 constituting the housing 13. The pickup lever 51 is rotated toward the paper bundle side, thereby causing the pickup roller 53 provided rotatably on the lower end (tip side) of the pickup lever 51 to be pressed against the top paper S of the paper bundle having a plurality of papers S. By rotating the pickup roller 53 in a state that the rolling contact surface 53*b* of the pickup roller 53 is pressed against the paper S, it is possible to feed out the paper S one by one.

As shown in FIGS. 6 and 7, the driving shaft 52 is provided along a rotating support axis P1 of the pickup lever 51. A clutch spring 60 serving as the torque transmitting member is provided between the driving shaft 52 and the pickup lever 51.

The clutch spring 60 is a friction clutch for integrally rotating the driving shaft 52 and the pickup lever 51 by frictional engagement. The clutch spring 60 serves to transmit a torque from the driving shaft 52 to the pickup lever 51 until a predetermined torque or more acts on the driving shaft 52 and to permit the relative rotation of the driving shaft 52 to the pickup lever 51 when the predetermined torque or more acts on the driving shaft 52.

As shown in FIGS. 7 to 9, the clutch spring 60 has a spiral spring drum portion 60*a* formed by a torsion coil spring to be frictionally engaged with the outer periphery of the driving shaft 52, and has two hooks 61 which are continuously linked to the spring drum portion 60*a* and can be engaged with hook receiving portions 51*p* formed on the pickup lever 51 respectively. The permitted transmitting torque of a torque transmitting member (a friction clutch) is set by the clutch spring 60 by a frictional engaging force between the spring drum portion 60*a* and the driving shaft 52.

The operation of the clutch spring 60 will be specifically described. When the driving shaft 52 of the pickup unit 50 is driven by the motor 49 the clutch spring 60 engaged frictionally with the outer periphery of the driving shaft 52 is rotated integrally with the driving shaft 52 and one of the hooks 61 abuts on one of the hook receiving portions 51*p*. When the driving shaft 52 is further rotated with one of the hooks 61 abutting on the hook receiving portion 51*p*, the abutting hook 61 of the clutch spring 60 rotated together with the driving shaft. 52 presses the hook receiving portion 51*p* in the circumferential direction of the driving shaft 52 so that the driving shaft 52 and the pickup lever 51 are interlockingly rotated integrally through the clutch spring 60.

For example, in the case where the pickup lever 51 is rotated in the direction of the paper, the pickup lever 51 is moved to a position in which the pickup roller 53 provided on the tip of the pickup lever 51 abuts on the paper S as shown in FIG. 6. When the motor 49 is further driven with the pickup roller 53 abutting on the paper S, a torque which is equal to or greater than a maximum static friction torque between the driving shaft 52 and the clutch spring 60 acts by a reaction received from the paper S by the pickup lever 51, and the outer periphery of the driving shaft 52 is disengaged from the clutch spring 60, that is, the interlock of the driving shaft 52 and the clutch spring 60 is released so that the driving shaft 52 is rotated with respect to the pickup lever 51. Consequently, the rotation of the driving shaft 52 is transmitted to the pickup roller 53 through the gears (rotation transmitting members) 54 to 59 so that the pickup roller 53 is rotated.

In order to conform the direction of the rotation of the driving shaft 52 for feeding the paper by the pickup roller 53, the number of the intermediate gears 55 to 58 interposed between the gear 54 at the input stage and the gear 59 at the output stage is set to be even.

As shown in FIGS. 3 and 4, the relief hole 15*b* for avoiding an interference with the rolling contact surface (rubber lining surface) 53*b* of the pickup roller 53 is provided in the opposed portion to the pickup roller 53 in the back cover 15. The relief hole 15*b* is provided to prevent the pickup roller 53 from locking by the frictional force generated by the direct contact of the rolling contact surface 53*b* of the pickup roller 53 with the paper guide surface 15*a* when all of the paper S is gone from the paper guide surface 15*a* of the back cover 15.

Figure 10A:
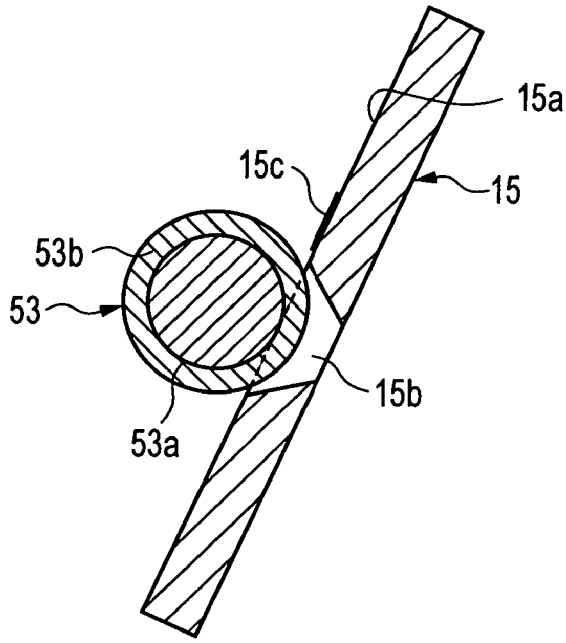
FIGS. 10A and 10B are views showing the relationship between a pickup roller in the pickup unit illustrated in FIG. 6 and the paper guide surface of a back cover, FIG. 10A being a sectional side view and FIG. 10B being a plan view showing the paper guide surface.

The relief hole 15*b* is set to be slightly larger than a width in the axial direction of the rolling contact surface 53*b*. As shown in FIG. 10A, moreover, the rocking position of the pickup lever 51 is controlled in such a manner that the pickup roller 53 does not come in contact with the back cover 15 with the rolling contact surface 53*b* of the pickup roller 53 inserting into the relief hole 15*b* to some extent as shown in FIG. 10A. For this reason, an engaging mechanism is provided between the pickup lever 51 and the housing 13. The engaging mechanism serves to control the rocking position of the pickup roller 53, thereby preventing contact with the back cover 15 when the rolling contact surface 53*b* enters the relief hole 15*b*.

Figure 10B:
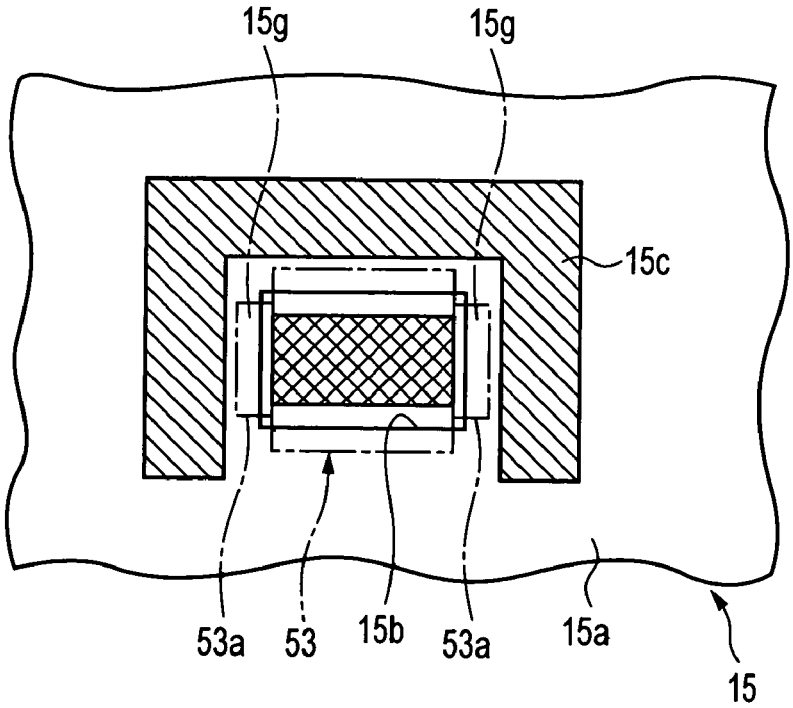
Figure 11:
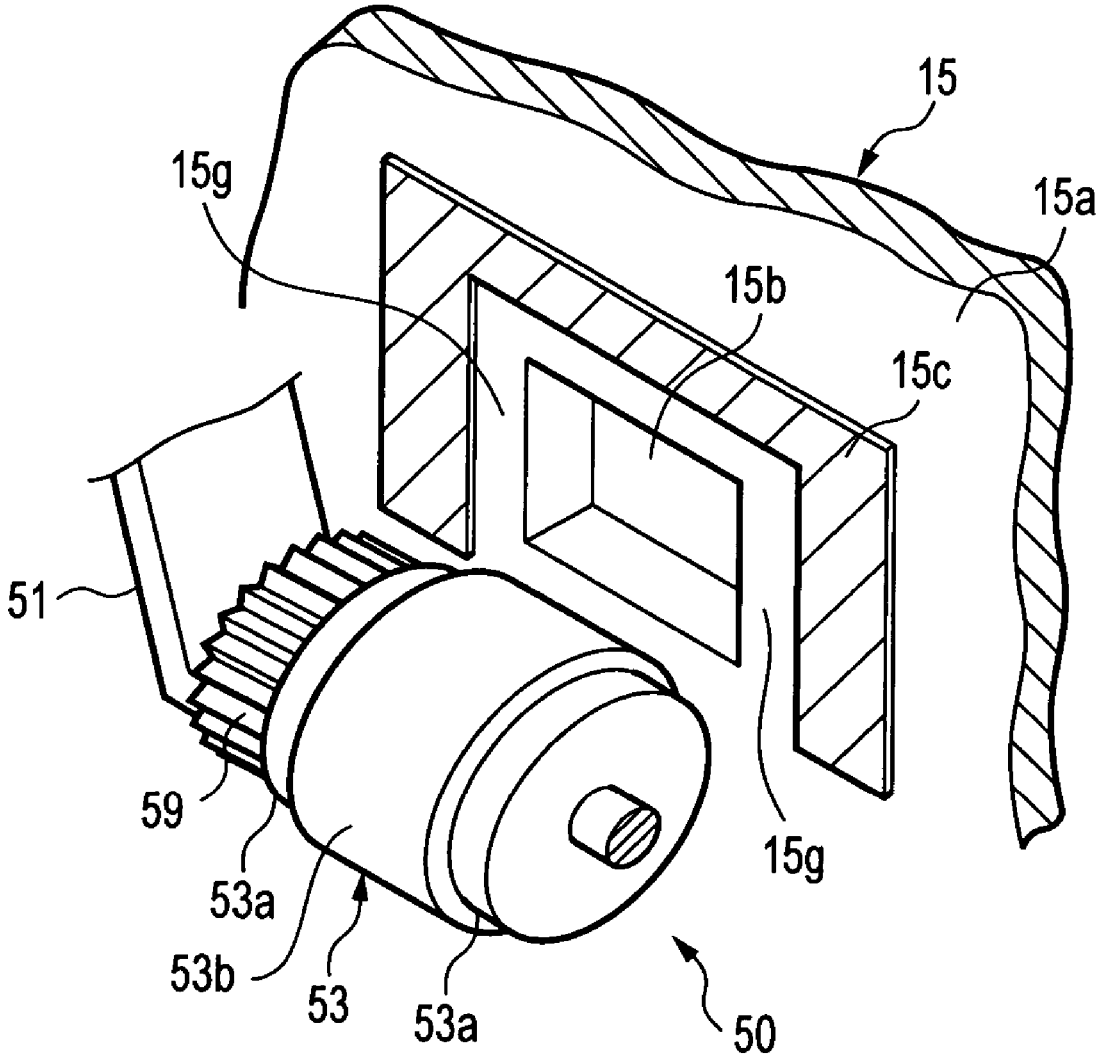
FIG. 11 is an enlarged perspective view showing a main part, illustrating the relationship between the pickup roller in the pickup unit of FIG. 6 and the paper guide surface of the back cover.

As shown in FIGS. 10 and 11, the engaging mechanism according to the embodiment includes the low friction rotating members 53*a* provided on both end sides in the axial direction of the pickup roller 53, and a receiving portion 15*g* on which the low friction rotating member 53*a* abuts in the paper guide surface 15*a* provided around the relief hole 15*b*.

The low friction rotating member 53*a* is a portion of the core member remaining without the rubber lining as described above. The low friction rotating member 53*a* has a smaller frictional resistance than that of the rolling contact surface 53*b* and can smoothly carry out slipping even if it comes in contact with the receiving portion 15*g* provided on the paper guide surface 15*a*. Thus, a high frictional force can be prevented from being generated.

In FIG. 10B, a portion shown in cross-hatching indicates a cross section of the opening surface of the pickup roller 53 and the relief hole 15*b* (an opening surface on the paper guide surface 15*a* side) which is obtained when the rolling contact surface 53*b* of the pickup roller 53 enters the relief hole 15*b*.

It is sufficient that the relief hole 15*b* is sized to avoid contact with the rolling contact surface 53*b* of the pickup roller 53 as the rocking position is controlled by the engaging mechanism, and a depth and a sectional shape are not restricted but are preferably as small as possible in order for the back cover 15 to sufficiently fulfill the paper guide function.

As shown in FIGS. 10A, 10B and 11, furthermore, a paper holding friction member 15*c* such as a cork sheet which has a higher frictional resistance than that of the paper guide surface 15*a* and has a lower frictional resistance than that of the rolling contact surface 53*b*, is provided on the paper guide surface 15*a* disposed around the relief hole 15*b*.

Even if the pressing force of the pickup roller 53 against the paper S is reduced when the second to last paper S is fed, and the frictional force between the paper guide surface 15*a* and the last paper S is reduced, the last paper S is still held by the paper holding friction member 15*c*. Therefore, feedin of two sheets simultaneously is prevented.

The paper holding friction member 15*c* is formed into a U-shape excluding a side portion in a paper feeding direction in four sides surrounding the relief hole 15*b*. The reason is that there is a possibility that a frictional resistance in that portion might get in the way, and the last paper S would not be fed smoothly if the paper holding friction member 15*c* is provided in the side portion in the paper feeding direction (downward in FIG. 10B). The receiving portion 15*g* against which the low friction rotating member 53*a* of the pickup roller 53 hits is provided inside of the paper holding friction member 15*c*.

As shown in FIG. 6, a cleaning member 40 formed by a high friction material for cleaning the rolling contact surface 53*b* of the pickup roller 53 by the rotation of the pickup roller 53 is positioned such that the peripheral surface of the pickup roller 53 is pressed against the cleaning member 40 when the pickup unit 50 is rotated away from the paper bundle S to a standby position.

Figure 12:
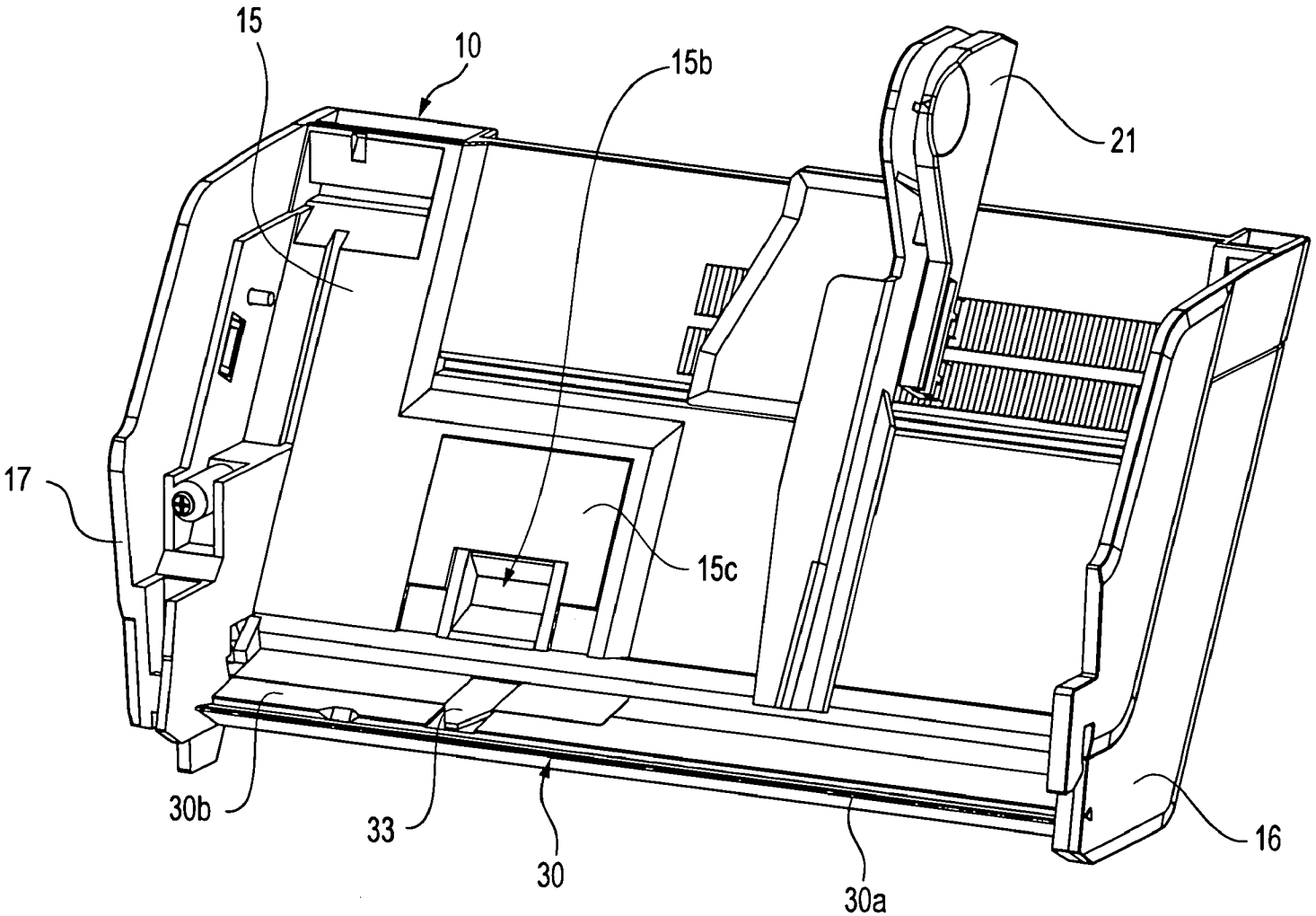
FIG. 12 is a partial perspective view showing the inner part of the paper feeding apparatus.

As shown in FIGS. 6 and 12, the movable plate 30 is provided under the back cover 15. The lower end of the paper bundle accommodated and held in the back cover 15 abuts on the movable plate 30. The movable plate 30 separates the paper S which is fed out and is rotatably supported by a shaft 31 provided on the back cover 15 side. Consequently, an extended portion 30*a* extended in the paper feeding direction can be tilted in a vertical direction. The extended portion 30*a* of the movable plate 30 is urged by a spring 32 so as to be lifted upward.

A friction member 33 constituted by a resin having a high coefficient of friction is attached to a partial region in the longitudinal direction of the movable plate 30 on an upper surface 30*b* of the movable plate 30. The friction member 33 is a paper holding member for holding the paper by a higher frictional force than the frictional force of other regions on the upper surface 30*b* of the movable plate 30 to which the friction member 33 is not attached. The paper bundle S has a tip engaged with the friction member 33 and is thus held on the upper surface 30*b* of the movable plate 30.

In the embodiment, it is necessary to provide the friction member 33 and the relief hole 15*b* on the inside of the movable range of the paper guide member 21. It is preferable that the friction member 33 should be positioned obliquely under the relief hole 15*b*, that is, under the pickup roller 53.

Next, description will be given to the action of the paper feeding apparatus 10 according to the embodiment.

In the embodiment, the driving shaft 52 is rotated by the motor 49, and the pickup lever 51 can be thus rotated through the clutch spring 60 as the torque transmitting member until a predetermined torque or more acts on the driving shaft 52. In that case, the direction of the rotation of the driving shaft 52 for feeding the paper by the pickup roller 53 is identical to the rotation direction of the driving shaft 52 in the rotation of the pickup lever 51 toward the paper S through the clutch spring 60. When the driving shaft 52 is rotated in the paper feeding direction, accordingly, the pickup roller 53 is pressed against the paper bundle. When the pickup roller 53 is pressed against the paper bundle, a torque acting on the driving shaft 52 is equal to or greater than a set torque. Consequently, the driving shaft 52 is rotated with respect to the pickup lever 51. The pickup roller 53 is rotated by the rotation of the driving shaft 52 and feeds one of the pressed papers S toward the printer body portion 1.

In this case, the pressing force of the pickup roller 53 is automatically determined by the set torque of the clutch spring 60 as the torque transmitting member. Accordingly, the pickup roller 53 can be pressed against the bundle of the papers S by a constant pressing force irrespective of the thickness of the bundle of the papers S (the number of the papers).

When the pickup unit 50 is returned to the standby position after the paper is completely fed, the motor 49 is rotated in reverse so that the driving shaft 52 is rotated in an opposite direction. When the driving shaft 52 is rotated in the opposite direction, the pickup lever 51 and the pickup roller 53 are automatically rotated away from the bundle of the papers S. The pickup roller 53 can easily pickup the paper S out of the paper feeding apparatus 10 without holding the bundle of the papers S.

With the spiral clutch spring 60 used as the torque transmitting member, it is possible to obtain an advantage that the driving shaft 52 and the pickup lever 51 can be engaged with and disengaged from each other by using small and inexpensive components and the components can easily be arranged. The pressing force of the pick-up roller 53 is automatically determined by the frictional engaging torque of the clutch spring 60.

Next, description will be given to the operation of the movable plate 30.

When the pickup roller 53 applies a force as to move the paper S downward by when the paper is fed, the lower end of the paper S first presses the upper surface 30*b* of the movable plate 30, particularly, the friction member 33 provided on the upper surface 30*b*. When the friction member 33 of the movable plate 30 is pressed, the movable plate 30 is tilted downward against the urging force of the spring 32. In other words, the pickup roller 53 feeds out the paper S so that the paper S presses the upper surface 30*b* of the movable plate 30, particularly, the friction member 33. Consequently, the movable plate 30 is tilted. A force for holding the paper S depends on the coefficient of friction of the friction member 33 provided on the upper surface 30*b* of the movable plate 30, the strength (rigidity) of the paper S and the angle of the movable plate 30.

When the movable plate 30 is gradually tilted, a force for disengaging the paper S from the friction member 33 and feeding out the paper S becomes greater than the holding force for holding the paper S in the friction member 33. The force for holding the paper S by the friction member 33 is gradually reduced. The moment that a certain angle at which the force for feeding out the paper S becomes greater than the force for holding the paper S is reached, the paper S is disengaged from the friction member 33 so that the paper S is fed toward the printer body portion 1.

Figure 14:
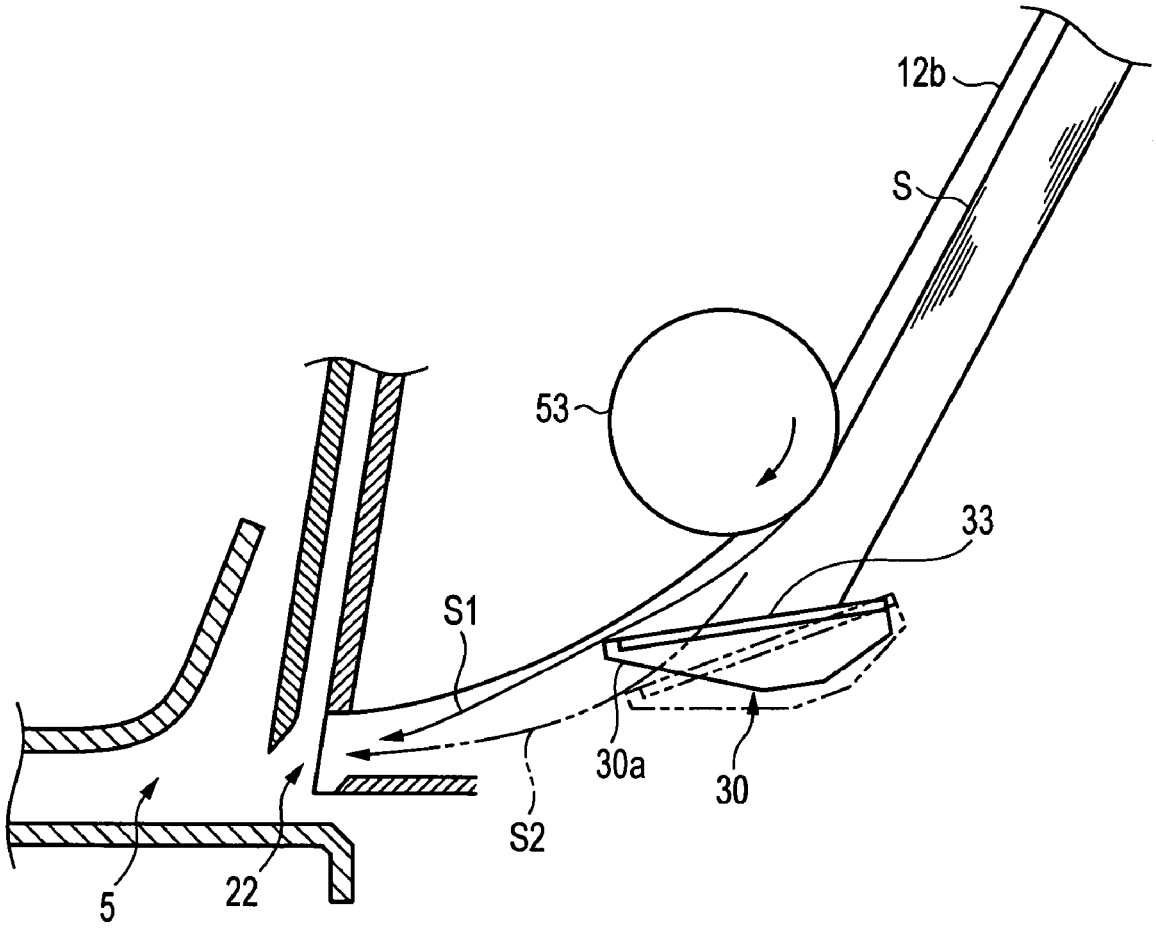
FIG. 14 is an explanatory view showing the action of the friction pad in the paper feeding apparatus.
Figure 15:
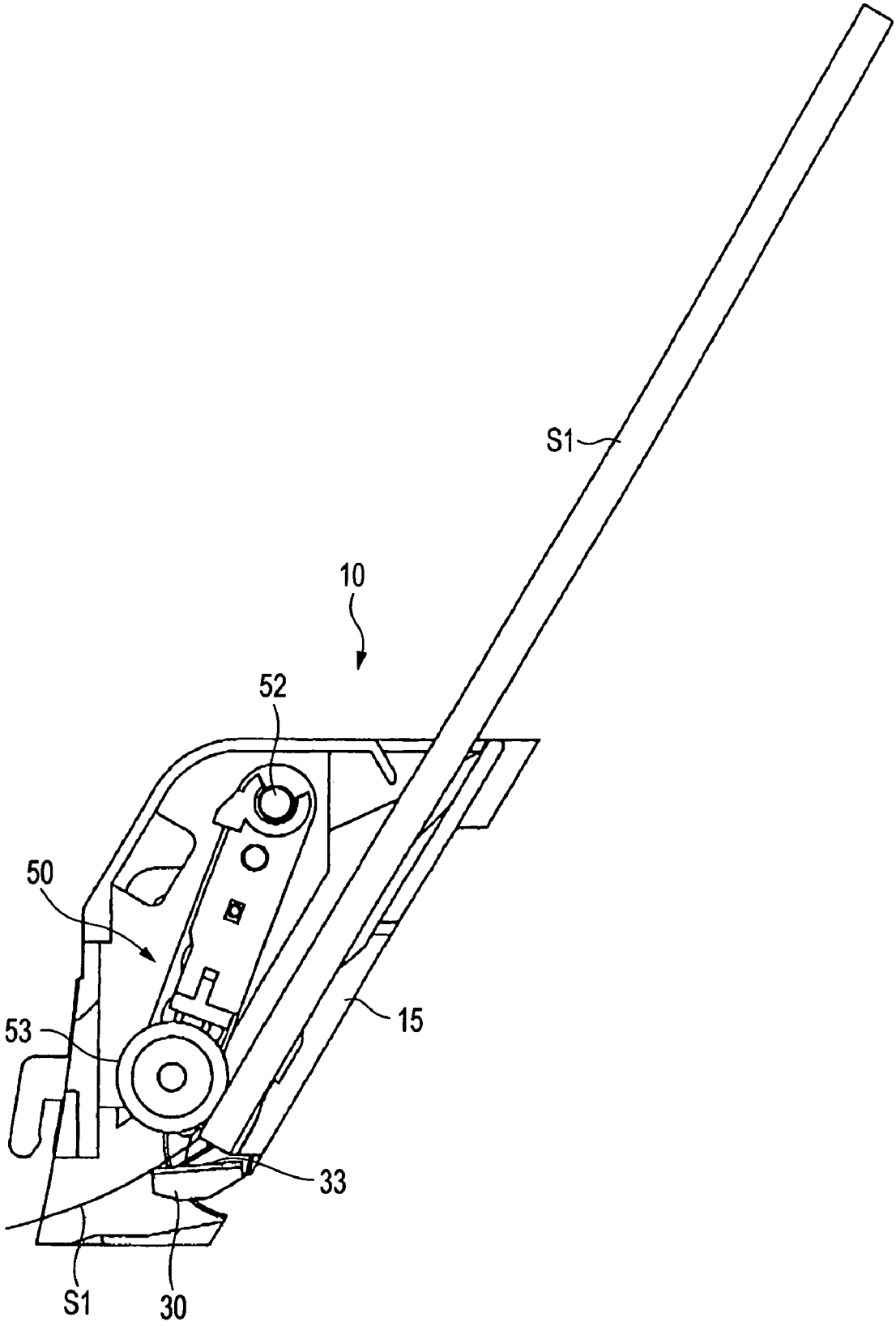
FIG. 15 is an explanatory view showing an action for feeding out paper having a high rigidity in the paper feeding apparatus.

When paper having a low rigidity (a paper having a small strength : a plain paper) S1 is fed as shown in FIGS. 14 and 15, the paper itself is apt to be flexed. Accordingly, the movable plate 30 is not greatly tilted but the paper S1 is flexed so that an angle between the paper S1 and the friction member 33 is decreased, and the,force for holding the paper S1 is reduced. Accordingly, a friction angle with the lower end of the paper S1 fed through the movable plate 30 (the angle of the movable plate 30) has a suitable value without applying a great load to the paper S1 so that the paper S1 can smoothly be separated and fed out.

Even when in the case that the angle of the movable plate 30 is small, the paper S1 is guided to the opening 22 along the guide end 12*b* of the attachment rib 12*a* formed integrally with the upper cover 12 and is delivered from the opening 22 to the paper feeding path 5 of the printer body portion 1. More specifically, when the paper S1 has a small strength and the paper separated from the movable plate 30 is not exactly fed toward the opening 22, the paper S1 is guided toward the opening 22 along the guide end 12*b* and is reliably delivered to the paper feeding path 5 of the printer body portion 1.

Figure 16:
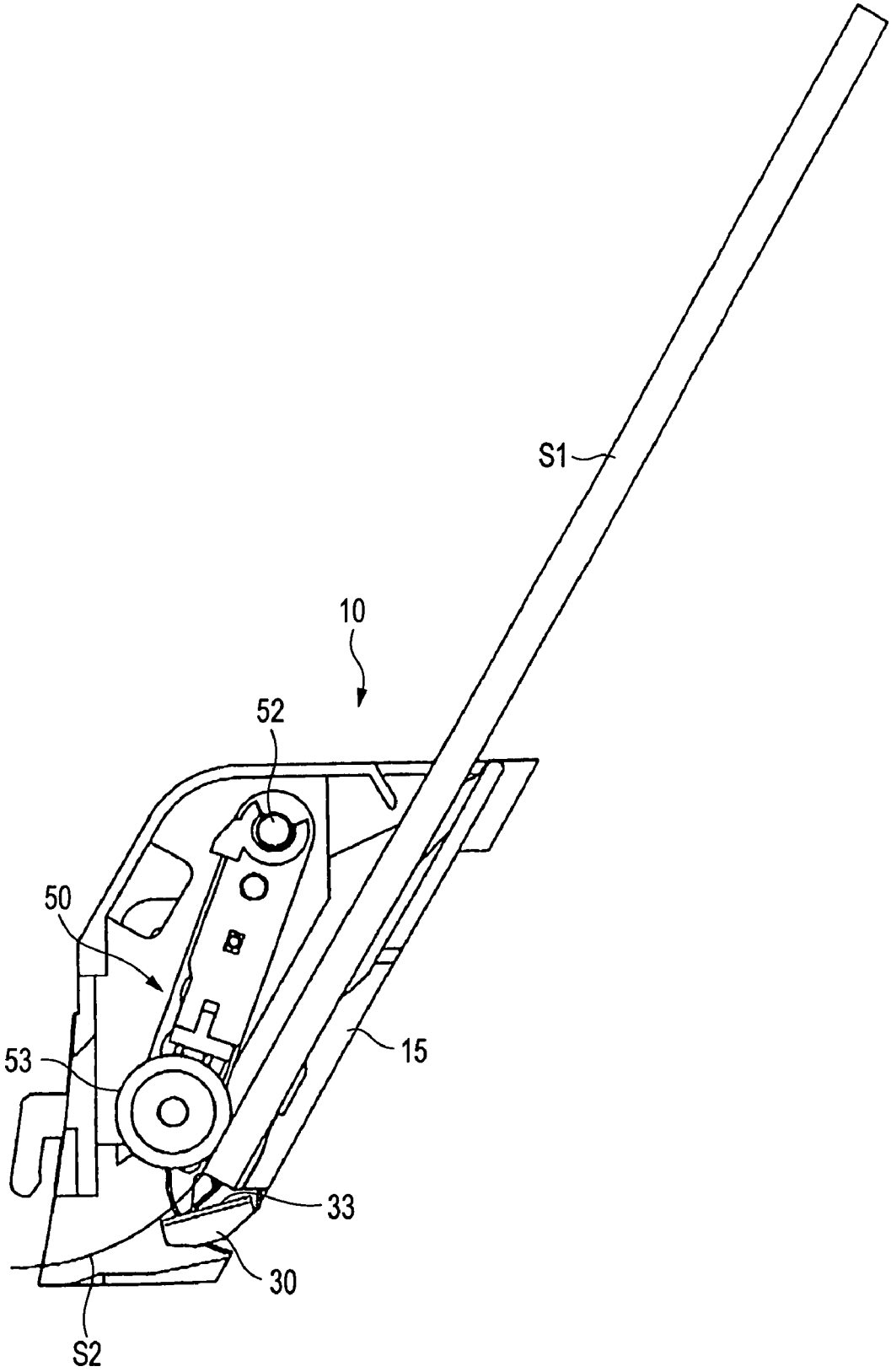
FIG. 16 is an explanatory view showing an action for feeding out a paper having a low rigidity in the paper feeding apparatus.

On the other hand, when a paper having a high rigidity (a paper having a great strength: a postcard) S2 is to be fed out as shown in FIGS. 14 and 16, the paper itself requires greater force to flex. If the movable plate 30 is not greatly tilted, accordingly, an angle between the paper S2 and the friction member 33 is not reduced. Therefore, the movable plate 30 is tilted farther downward in a state that a greater load is applied to the paper S2 having a high rigidity as compared with the paper S1. When the movable plate 30 is gradually tilted, the angle of the movable plate 30 with respect to the paper bundle including the paper S2 is decreased so that the friction angle with respect to the lower end of the paper S2 to be fed out has a suitable value. Consequently, the paper S2 can be smoothly separated and fed out.

In other words, in the paper feeding apparatus 10 according to the embodiment, the movable plate 30 is tilted so that the paper can be smoothly separated and supplied without the influence of the rigidity (strength) of each of the papers S1 and S2. Accordingly, the movable plate 30 separates each of the papers S at a suitable friction angle for the rigidity of the paper S. For example, it is possible to reliably separate the paper S irrespective of a rigidity, e.g., obtained by a difference in the thickness of the paper S.

If the friction member 33 is provided obliquely under the relief hole 15*b*, that is, under the pickup roller 53, the friction member 33 is disposed in the paper feeding direction based on the pickup roller 53. Accordingly, the friction member 33 can receive a force for feeding out the paper S by the rotating force of the pickup roller 53 almost perpendicularly to the paper feeding direction, and a friction force between the tip of the paper S and the friction member 33 can be efficiently gained without torsion or flexure of the paper in the transverse direction thereof. Moreover, the paper resists being distorted or flexed in the transverse direction of the paper. Consequently, the paper can easily be delivered within an assumed range, and precision in a paper delivery position can easily be obtained.

After the paper is completely fed, the driving shaft 52 is rotated in a reverse direction and the pickup lever 51 is rotated so that the pickup roller 53 is separated from the paper bundle. Therefore, it is possible to easily take the paper or the paper bundle out of the paper feeding apparatus 10. When the driving shaft 52 is continuously rotated for several seconds such that the pickup lever 51 is rotated to a standby position, the peripheral surface of the pickup roller 53 is rubbed against the cleaning member 40 and refuse on the paper and various components coating the paper which attached to the peripheral surface of the pickup roller 53 are shaved off by the cleaning member 40 so that the peripheral surface of the pickup roller 53 can be cleaned. The pressing force for the cleaning member 40 is determined by the set torque of the clutch spring 60.

In the paper feeding apparatus 10 according to the embodiment, it is thus possible to automatically clean the pickup roller 53 by simply returning the pickup unit 50 to the standby position. Consequently, it is possible to enhance the durability of the pickup roller 53 and to prevent a paper feeding failure by maintaining a stable coefficient of friction.

Figure 13A:
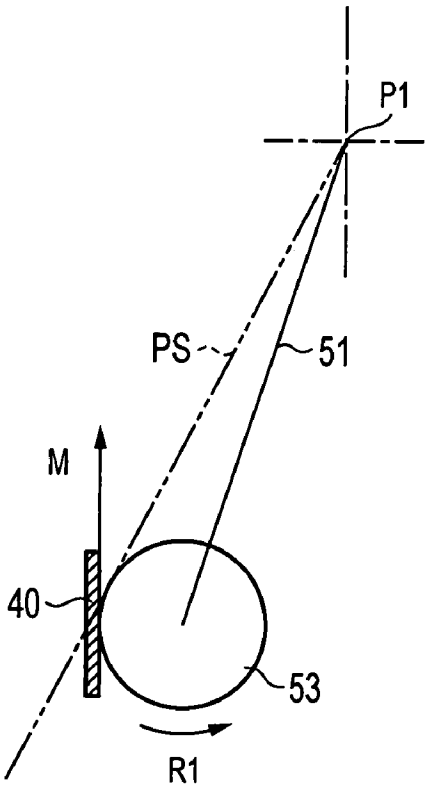
FIGS. 13A to 13C are explanatory views showing the proper attachment angle of a cleaning member in the paper feeding apparatus, FIG. 13A being a view showing a non-preferable attachment angle, and FIGS. 13B and 13C being views showing preferable attachment angles.
Figure 13B:
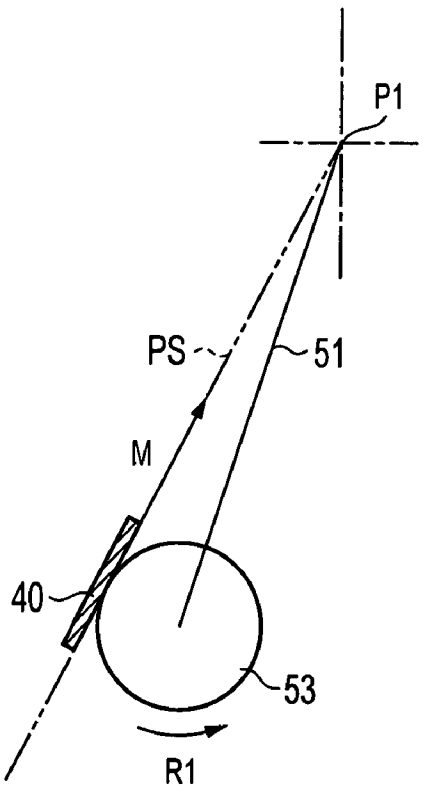
Figure 13C:
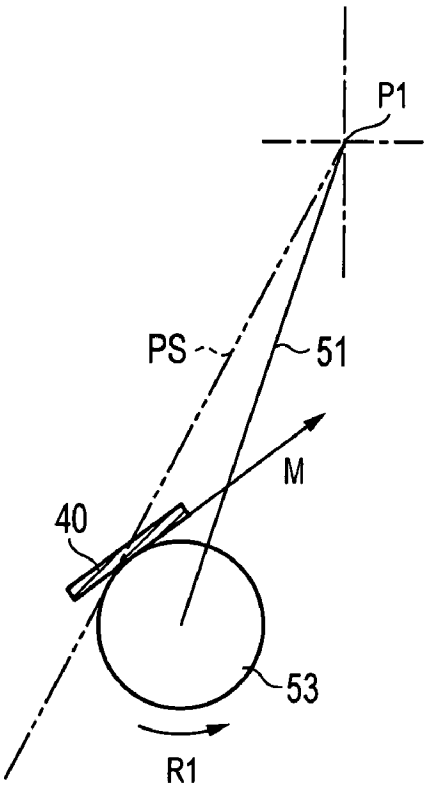

As shown in FIGS. 13A to 13C, it is preferable that the attachment angle of the cleaning member 40 should be set equal to the angle of a tangential line PS drawn from the rotating support axis P1 of the pickup lever 51 to the peripheral surface of the pickup roller 53 (a state shown in FIG. 13B) or the cleaning member 40 should be tilted in such that a closer portion to the rotating support axis P1 is placed on an inside from the tangential line PS (a state in FIG. 13C). The reason is that when the cleaning member 40 is tilted in such that the closer portion to the rotating support axis P1 is placed on the outside of the tangential line PS (a state in FIG. 13A), a friction force M applied by the rotation of the pickup roller 53 (a rotation in the direction of an arrow R1) acts as a force for locking the rotation of the pickup roller 53.

Figure 17:
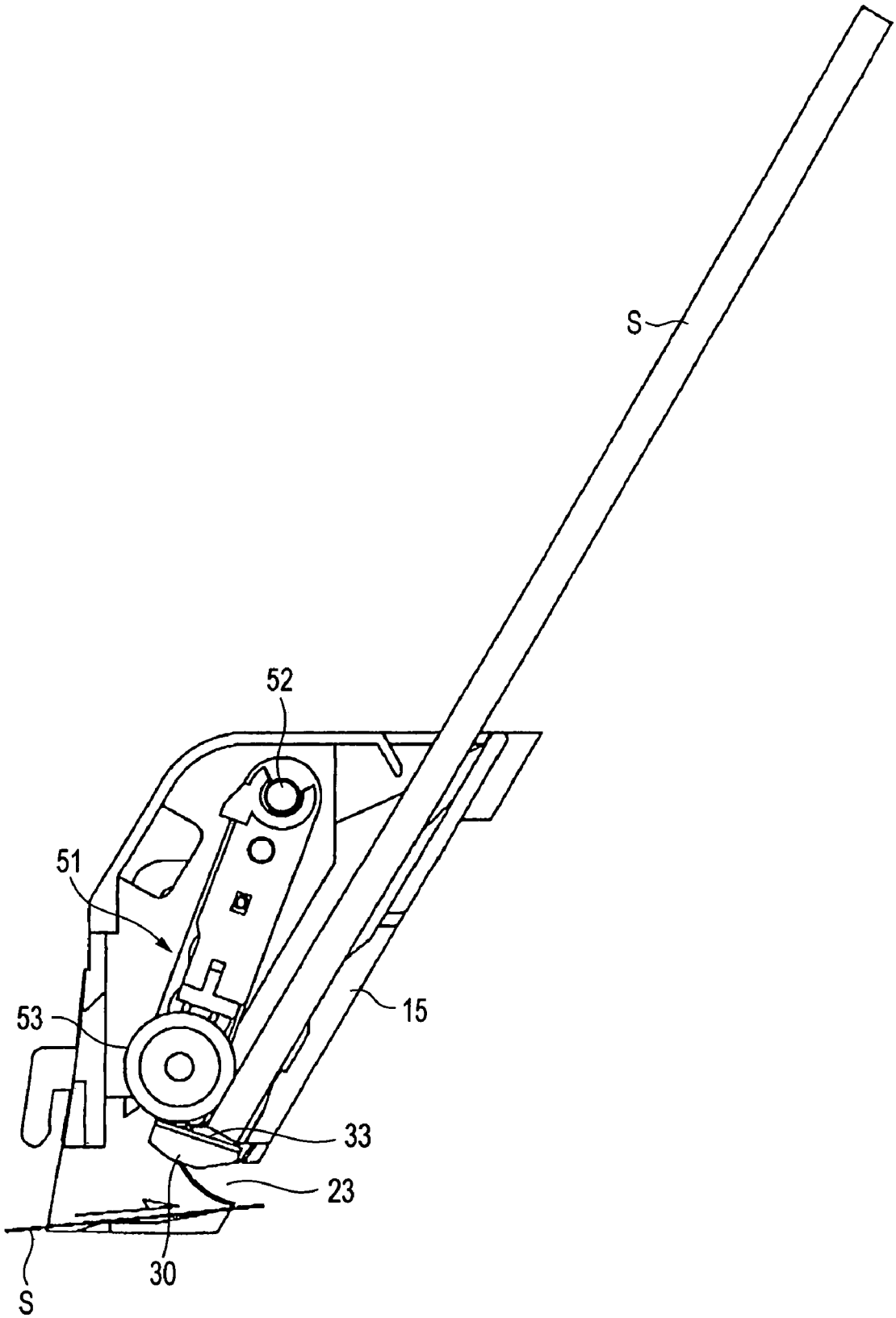
FIG. 17 is an explanatory view showing the case that the rear end of a paper in the paper feeding apparatus is caused to escape rearward.

When the paper S is regulated by a forward or backward movement to take out a tip thereof, there is a possibility that the rear end of the paper S to be moved backward might interfere with the movable plate 30 when the strength of the paper S is great. In the paper feeding apparatus 10 according to the embodiment, however, the opening 23 is formed on the lower end of the back cover 15 as shown in FIG. 17. Therefore, the rear end of the paper S can be moved rearward from the opening 23 on the back face. Therefore, when the tip of the high strength paper S is to be taken out, the rear end of the paper S is smoothly moved. The opening 23 is positioned on the extended line of the paper feeding path of the printer body portion 1 as a paper supply source, and is placed in such a position that the paper S can be moved through the underside of the movable plate 30.

If the relief hole 15*b* is not provided on the back cover 15, there is a possibility that the rolling contact surface 53*b* of the pickup roller 53 might directly come in contact with the paper guide surface 15*a* when the paper S is gone from the paper guide surface 15*a*. In the paper feeding apparatus 10 according to the embodiment, however, the relief hole 15*b* for avoiding the interference with the rolling contact surface 53*b* is provided in the opposed position to the rolling contact surface 53*b* of the pickup roller 53 in the back cover 15, and a contact with the paper guide surface 15*a* is prevented by the engaging mechanism when the rolling contact surface 53*b* enters the relief hole 15*b*.

In the case that the paper S is gone from the paper guide surface 15*a*, accordingly, the rolling contact surface 53*b* of the pickup roller 53 enters the relief hole 15*b* and does not directly hit against the paper guide surface 15*a*. This state is maintained by the abutment of the low friction rotating member 53*a* provided adjacently to both sides of the pickup roller 53 on the receiving portion 15*g* provided on the paper guide surface 15*a* to regulate a position. In addition, in this state, the low friction rotating member 53*a* simply carries out the slipping smoothly with respect to the receiving portion 15*g* and high friction is not generated. For this reason, an excessive load is not applied to the pickup roller 53 and the pickup lever 51.

Accordingly, the rolling contact surface 53*b* of the pickup roller 53 can carry out slipping without coming in contact with another member (the back cover 15) and friction is rarely generated between the pickup roller 53 and the paper guide surface 15*a* so that the pickup roller 53 can be prevented from being locked.

When the second to last paper S is fed, the last paper S is stably held by the paper holding friction member 15*c* provided around the relief hole 15*b*, and feeding of two sheets simultaneously is prevented.

Furthermore, the relief hole 15*b* is provided on the back cover 15, and the paper holding friction member 15*c* is simply provided therearound. As compared with the case in which a free rotating roller and a spring are provided as in a related paper feeding apparatus, the number of components and manufacturing costs are reduced.

In the paper feeding apparatus 10 according to the embodiment, moreover, when the paper S is gone and the rolling contact surface 53*b* of the pickup roller 53 enters the relief hole 15*b*, the position of the pickup roller 53 is regulated by the abutment of the low friction rotating member 53*a*.

As a result, in the closest position to the rolling contact surface 53*b* of the pickup roller 53 to prevent contact with the back cover 15, it is possible to reliably regulate the rocking position of the pickup roller 53.

Accordingly, it is possible to prevent a situation that the rolling contact surface 53*b* of the pickup roller 53 hits against the paper guide surface 15*a* by mistake due to an assembly error. Thus, it is possible to enhance paper feeding reliability.

While the clutch spring 60 is used as the torque transmitting member in the embodiment, it is not limited. It is sufficient that an engagement with the driving shaft 52 is carried out until a torque having a predetermined value or more is applied, and the engagement is released when the torque having the predetermined value or more is applied.

The engaging mechanism of the paper feeding apparatus 10 according to the invention is not limited to the structure according to the embodiment but it is apparent that the same engaging mechanism can employ various structures to prevent contact with the back cover 15 when the rolling contact surface 53*b* of the pickup roller 53 enters the relief hole 15*b*.

For example, it is also possible to provide a stopper to hit against the back cover 15 in the rocking tip portion of the pickup lever 51, thereby regulating the rocking range of the pickup roller 53. By engaging the base end side of the pickup lever 51 with a stopper protruded from the attachment rib 12*a* of the upper cover 12, it is also possible to regulate the rocking range of the pickup roller 53.

It is preferable to precisely regulate the position of the pickup roller 53 in a close position to the back cover 15 if possible. When the low friction rotating member 53*a* provided on both end sides in the axial direction of the pickup roller 53 is caused to abut on the receiving portion 15*g* provided around the relief hole 15*b*, it is not necessary to precisely configure the pickup lever 51 components to be rotated by the driving shaft 52. Consequently, it is possible to reduce manufacturing costs of the engaging mechanism.

Second Embodiment

A second embodiment of the paper feeding apparatus according to the invention will be described below with reference to the drawings. The paper feeding apparatus according to the second embodiment relates to an example in which the clutch spring 60 used in the paper feeding apparatus according to the first embodiment is replaced, and the other structures are the same as the structure according to the first embodiment. In the following description, the description of the same members as those in the first embodiment will be omitted in order to avoid repetition.

Figure 18:
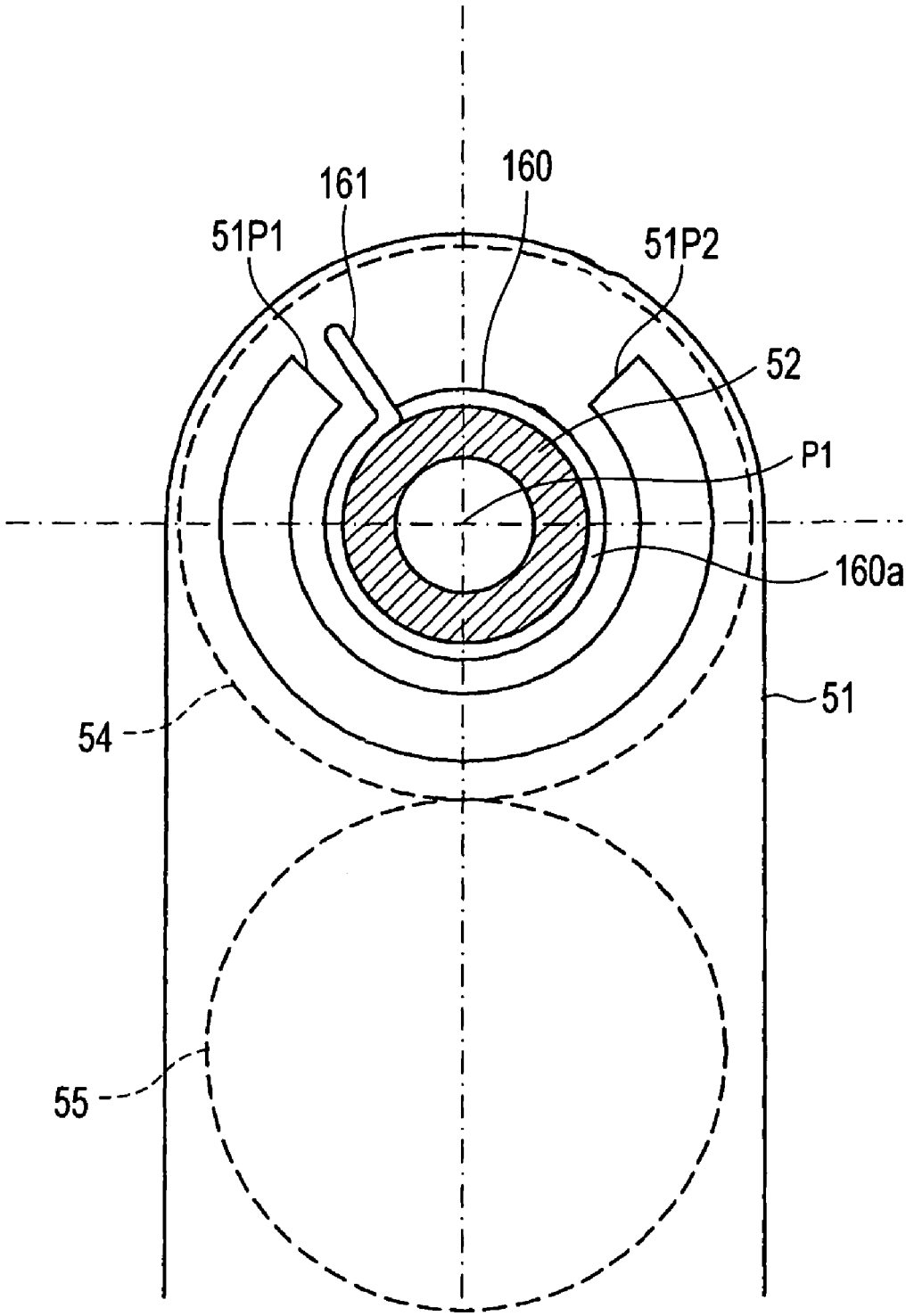
FIG. 18 is an explanatory view showing a clutch spring attached to the driving shaft of a pickup unit according to a second embodiment of the invention.
Figure 19:
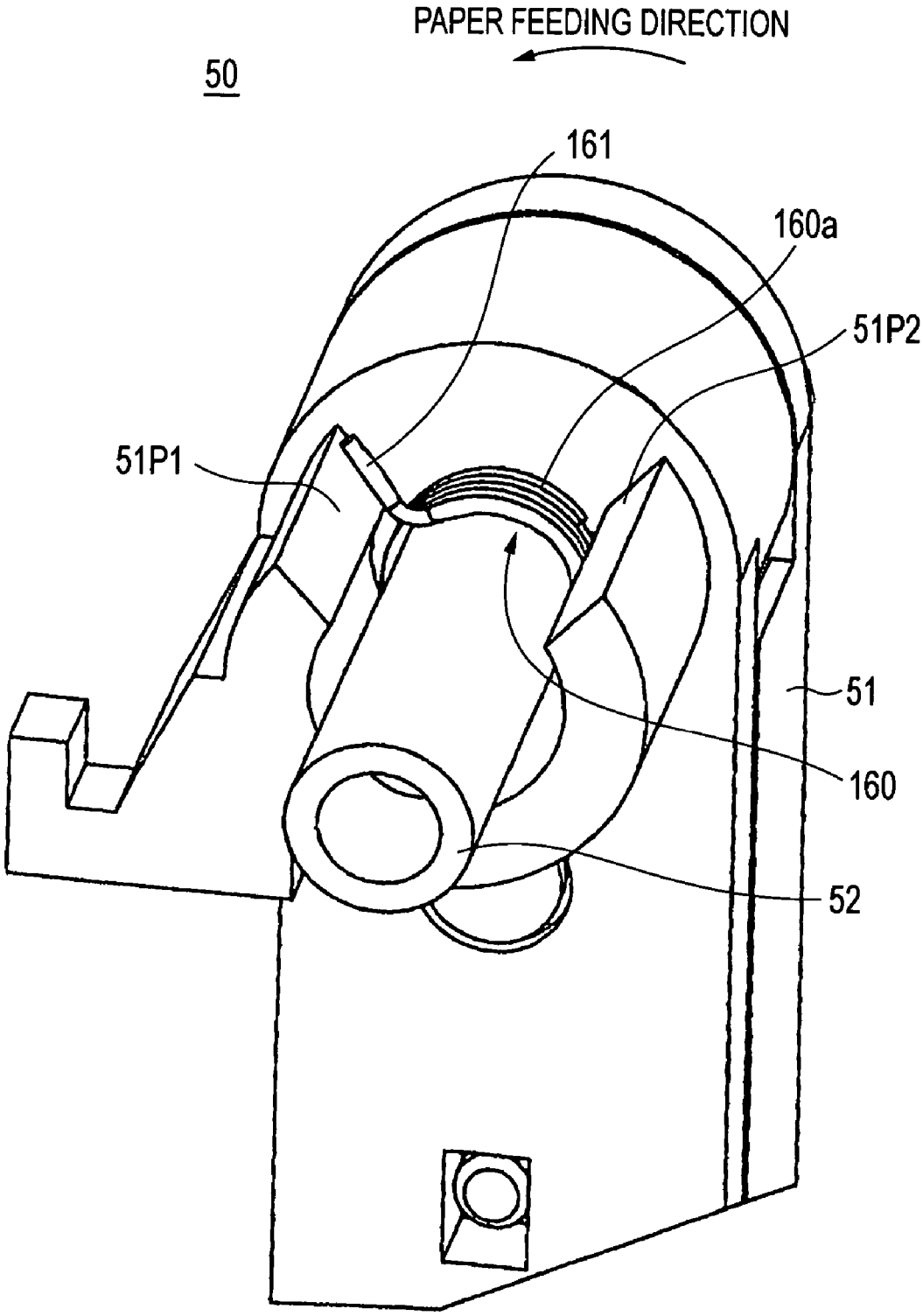
FIG. 19 is a perspective view showing a state that the clutch spring is urged in a paper feeding direction.
Figure 20:
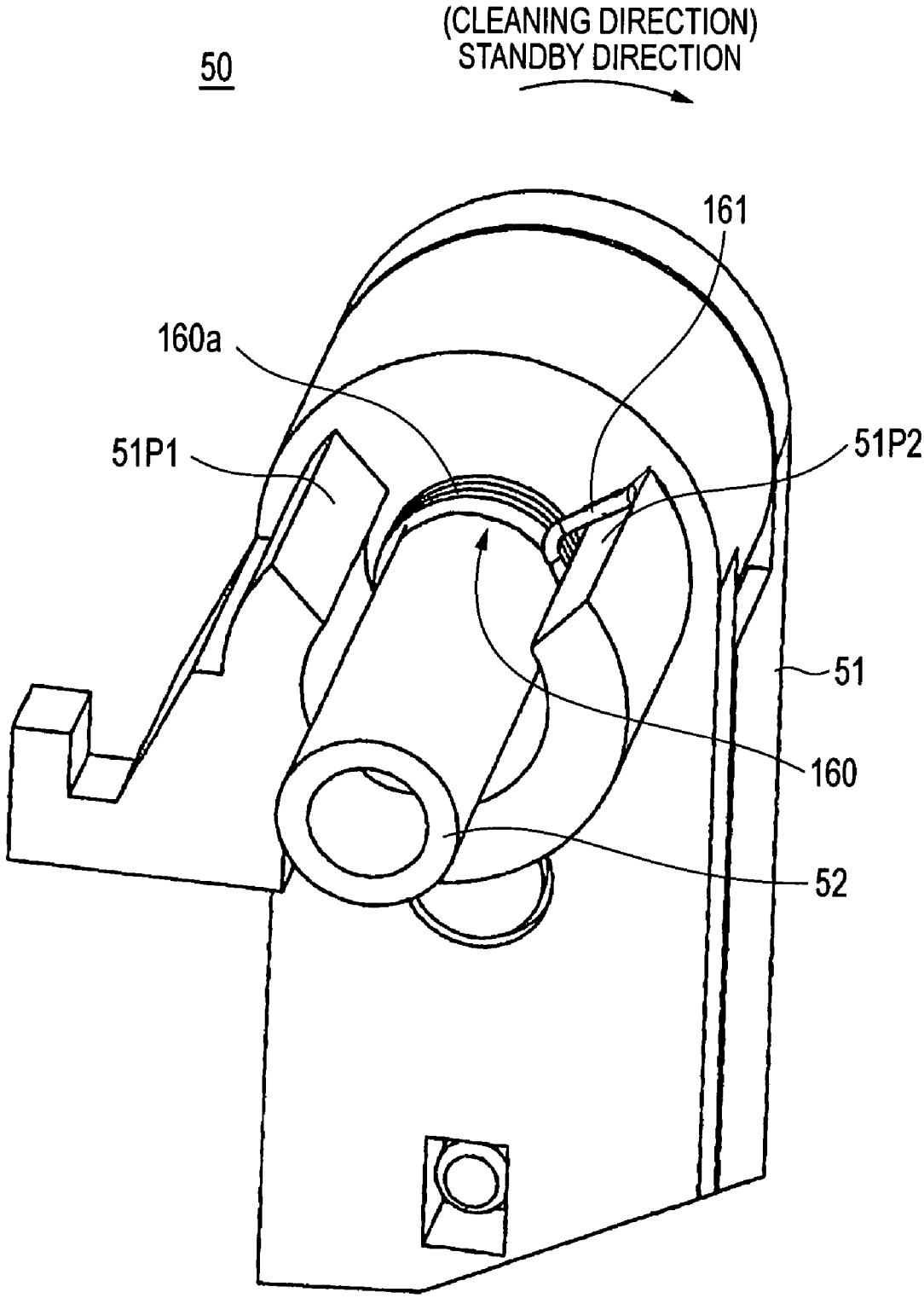
FIG. 20 is a perspective view showing the clutch spring urged in a cleaning direction.
Figure 21:
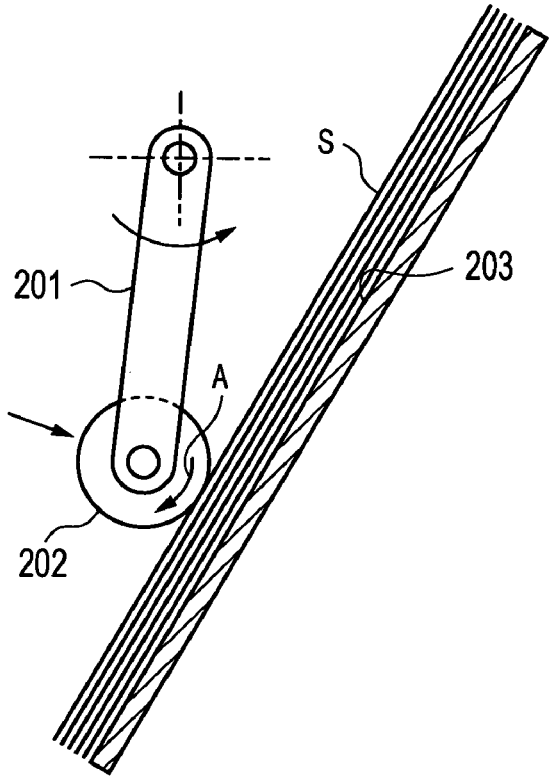
FIG. 21 is an explanatory view showing a general paper feeding principle structure.
Figure 22:
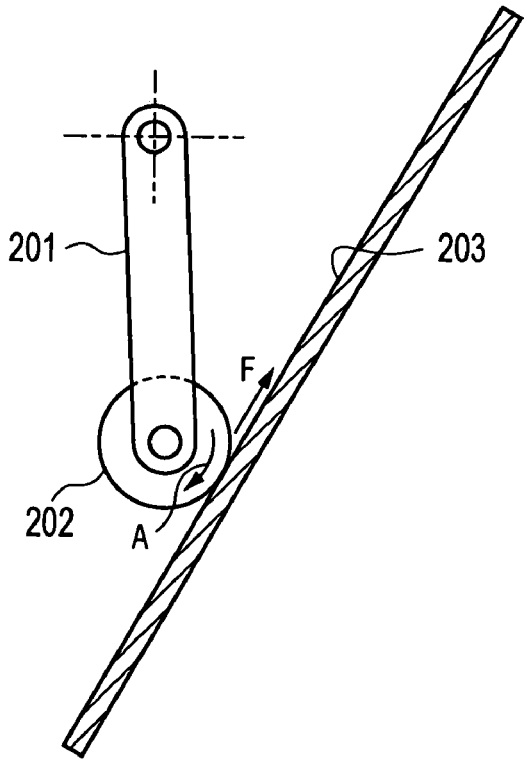
FIG. 22 is a view for explaining a problem caused when a paper is gone in the principle structure of FIG. 21.
Figure 23:
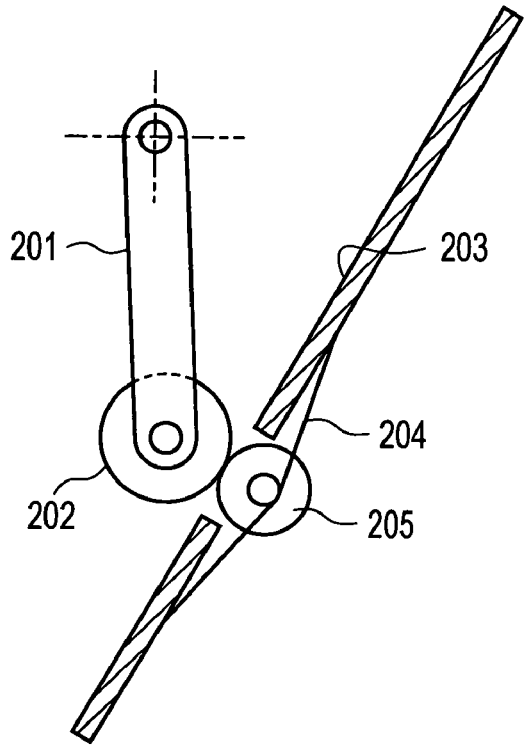
FIG. 23 is a view showing a state in which a paper is gone in a related paper feeding apparatus.
Figure 24:
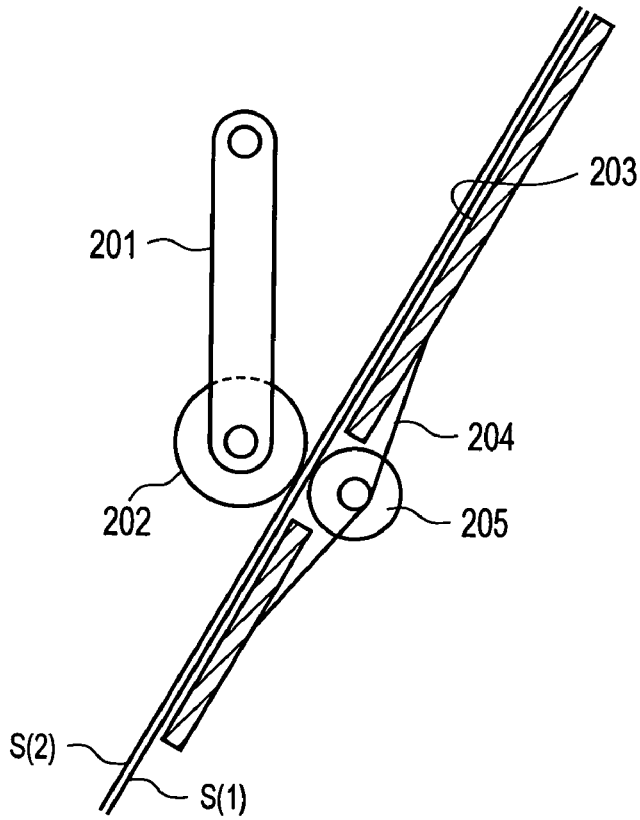
FIG. 24 is a view for explaining a problem in the paper feeding apparatus shown in FIG. 23.

FIG. 18 is an explanatory view showing a clutch spring 160 attached to the driving shaft of a pickup unit 50, FIG. 19 is a perspective view showing a state in which the clutch spring 160 is urged in a paper feeding direction, and FIG. 20 is a perspective view showing a state in which the clutch spring 160 is urged in a cleaning direction.

The clutch spring 160 is provided as a torque transmitting member between a driving shaft 52 and a pickup lever 51 in the same manner as the clutch spring 60 according to the first embodiment. The clutch spring 160 transmits a torque from the driving shaft 52 to the pickup lever 51 through the engagement state of the driving shaft 52 with the pickup lever 51 until a predetermined torque or more acts on the driving shaft 52 and subsequently releases the engagement to permit rotation of the driving shaft 52 with respect to the pickup lever 51.

As shown in FIG. 18, the clutch spring 160 has a spiral spring drum portion 160*a* which is frictionally engaged with the outer periphery of the driving shaft 52 and is wound in one direction, and one hook 161 which is continuously linked to one of the ends of the spring drum portion 160*a*. The hook 161 can be engaged with hook receiving portions 51*p*1 and 51*p*2 formed on the pickup lever 51. In contrast with the first embodiment, only one hook 161 is formed on the one and of the spring drum portion 160*a*, which can be engaged with the two hook receiving portions 51*p*1 and 51*p*2 formed on the pickup lever. For the clutch spring 160, a set torque for the torque transmitting member is determined by a frictional engaging force between the spring drum portion 160*a* and the driving shaft 52.

The operation of the pickup unit 50 according to the second embodiment will be described below. When the driving shaft 52 of the pickup unit 50 is driven by a motor 49, the clutch spring 160 engaged frictionally with the outer periphery of the driving shaft 52 is rotated integrally with the driving shaft 52 so that the hook 161 abuts on one of the hook receiving portions 51*p*1 and 51*p*2. When the driving shaft 52 is further rotated such that the hook 161 abuts on one of the hook receiving portions 51*p*1 and 51*p*2, the hook 161 of the clutch spring 160 rotated together with the driving shaft 52 presses one of the hook receiving portions 51*p*1 and 51*p*2 in the circumferential direction of the driving shaft 52 so that the driving shaft 52 and the pickup lever 51 are interlocked and rotated integrally through the clutch spring 160.

When the pickup lever 51 is rotated in the direction of the paper, for example, the pickup lever 51 is moved to a position in which the pickup roller 53 provided on the tip of the pickup lever 51 abuts the paper S. When the motor 49 is further driven, a torque which is equal to or greater than a maximum static friction torque between the driving shaft 52 and the clutch spring 160 acts by a reaction received from the paper S by the pickup lever 51, and the engagement of the outer periphery of the driving shaft 52 with the clutch spring 160 is released, that is, the interlock of the driving shaft 52 with the clutch spring 160 is released so that the driving shaft 52 can be rotated with respect to the pickup lever 51. Consequently, rotation of the driving shaft 52 is transmitted to the pickup roller 53 through gears (rotation transmitting means) 54 to 59 so that the pickup roller 53 is rotated.

In the clutch spring 160 according to the second embodiment, one hook 161 is engaged with two hook receiving portions 51*p*1 and 51*p*2 differently from the clutch spring 60 according to the first embodiment. For this reason, when the hook 161 abuts on the hook receiving portion 51*p*1 to press the hook receiving portion 51*p*1 (see FIG. 19) and when the hook 161 abuts on the hook receiving portion 51*p*2 to press the hook receiving portion 51*p*2 (see FIG. 20), the torques required for releasing the engagement of the spring drum portion 160*a* with the driving shaft 52 are different from each other.

When the hook 161 abuts on the hook receiving portion 51*p*1 to press the hook receiving portion 51*p*1, a force applied from the hook receiving portion 51*p*1 to the hook 161 acts in such a direction as to loosen the spring drum portion 160*a* wound upon the driving shaft 52 as shown in FIG. 19. Accordingly, the engagement between the driving shaft 52 and the spring drum portion 160*a* of the clutch spring 160 is released.

On the other hand, when the hook 161 abuts on the hook receiving portion 51*p*2 to press the hook receiving portion 51*p*2, a force applied from the hook receiving portion 51*p*2 to the hook 161 acts to tighten the spring drum portion 160*a* wound upon the driving shaft 52 as shown in FIG. 20. Accordingly, the maximum static friction torque required for releasing the engagement between the driving shaft 52 and the spring drum portion 160*a* of the clutch spring 160 becomes greater than that in the state shown in FIG. 18. More specifically, a greater torque is required for releasing the engagement of the driving shaft 52 with the spring drum portion 160*a* of the clutch spring 160 when the hook 161 presses the hook receiving portion 51*p*2 than that when the hook 161 presses the hook receiving portion 51*p*1.

In the second embodiment, when the paper is fed, that is, when the pickup roller 53 is abutted on the paper S and the paper S is fed by the pickup roller 53, the hook 161 is abutted on the hook receiving portion 51*p*1. To the contrary, in the cleaning (standby) position, the hook 161 is abutted on the hook receiving portion 51*p*2. More specifically, in the second embodiment, a torque required for rotating the pickup roller 53 for feeding the paper is smaller than a torque required for rotating the pickup roller 53 for cleaning.

When a large torque is applied to the driving shaft 52 so that the pickup roller 53 is abutted on the paper S, the pickup roller 53 is rotated strongly press the bundle of the papers S. Consequently, there is a possibility that at least two papers S might be delivered, that is, a double feed might occur.

On the other hand, when the pickup unit 50 is set in the standby state, it is preferable that the pickup unit 50 should be pressed tightly and strongly against the cleaning member 40 such that the pickup lever 52 is not vibrated in the standby state, or the pickup roller 53 is not rotated in the standby state.

As described above, according to the paper feeding apparatus 10 of the second embodiment, the driving shaft 52 is rotated so that the pickup lever 51 can be rotated through the clutch spring 160 until a predetermined torque or more acts on the driving shaft 52. In that case, the driving shaft 52 rotation direction while feeding of the paper by the pickup roller 53 is identical to the driving shaft 52 rotation direction while rotating the pickup lever 51 toward the paper bundle through the clutch spring 160. By rotating the driving shaft 52 in the paper feeding direction, therefore, it is possible to press the pickup roller 53 against the paper bundle. In the pressing stage, a predetermined torque or more acts on the driving shaft 52. Consequently, the driving shaft 52 is rotated with respect to the pickup lever 51 and the pickup roller 53 is rotated by rotation of the driving shaft 52, thereby feeding out the paper S placed on the uppermost layer of the paper bundle. In this case, the pressing force of the pickup roller 53 is automatically determined by the set torque of the clutch spring 60. Therefore, the pickup roller 53 can be pressed against the paper bundle by a constant pressing force irrespective of the thickness of the paper S (the number of the papers).

In the standby position, the pickup roller 53 is rotated by a small torque force in the feed of the paper so that the double feed of the paper S can be prevented, and furthermore, the pickup roller 53 is not rotated until a greater torque force than that in the feed of the paper is applied in the standby so that the pickup unit 50 including the pickup roller 53 can be reliably held in the standby position.

While the paper feeding apparatus used in the printer is described in the embodiment, the paper feeding apparatus according to the present invention may be applied to a copy machine, a facsimile and a scanner and so on.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A paper feeding apparatus, comprising:
- a housing for accommodating a plurality of papers;
- a pickup unit including:
  - a pickup lever;
  - a driving shaft rotatably supporting the pickup lever;
  - a pickup roller rotatably provided on an end of the pickup lever; and
  - a rotation transmitting member transmitting a rotating force of the driving shaft to the pickup roller; and
- a torque transmitting member, provided between the driving shaft and the pickup lever, the torque transmitting member being selectively engageable with the driving shaft to transmit a torque acting on the driving shaft to either the pickup lever or the pickup roller depending on an amount of the torque acting on the driving shaft,
- wherein the pickup roller is rotated while being pressed against the papers, thereby feeding the papers one by one.

2. The paper feeding apparatus according to claim 1, wherein the torque transmitting member is configured such that when the torque is smaller than a predetermined value, the pickup lever is rotated with the driving shaft; and
- such that when the torque is equal to or greater than the predetermined value, the pickup roller is rotated with the driving shaft.

3. The paper feeding apparatus according to claim 2, wherein the pickup lever has a hook receiving portion;
- wherein the torque transmitting member has a hook portion to be engaged with the hook receiving portion, and has a spring drum portion to be engaged frictionally with an outer face of the driving shaft; and
- wherein the predetermined value is set by a frictional engaging force of the spring drum portion.

4. The paper feeding apparatus according to claim 2, wherein the predetermined value of the torque is varied depending on a driving shaft rotation direction.

5. The paper feeding apparatus according to claim 1, wherein the torque transmitting member rotates the pickup lever in conjunction with the driving shaft in accordance with a first rotation direction of the driving shaft so that the pickup roller is pressed against the paper.

6. The paper feeding apparatus according to claim 5, wherein the torque transmitting member rotates the pickup lever in conjunction with the driving shaft in accordance with a second rotation direction of the driving shaft so that the pickup roller is moved to a standby position away from the paper.

7. The paper feeding apparatus according to claim 1, further comprising a cleaning member, cleaning a peripheral face of the pickup roller by rotating the pickup roller.

8. The paper feeding apparatus according to claim 7, wherein the peripheral face of the pickup roller is positioned so as to be rubbed against the cleaning member when the pickup roller is positioned at a standby position away from the paper.

9. The paper feeding apparatus according to claim 7, wherein a cleaning operation of the pickup roller by the cleaning member is executed after the paper is fed by the pickup roller.

10. The paper feeding apparatus according to claim 1, further comprising:
- a movable plate provided in the housing;
- a first friction member provided on the movable plate and on which lower ends of the papers accommodated in the housing abut; and
- an urging member urging the movable plate in a direction opposite from a paper feeding direction.

11. The paper feeding apparatus according to claim 10, wherein the movable plate is pressed and tilted by the paper which is fed out by the pickup roller.

12. The paper feeding apparatus according to claim 10, wherein the housing has an opening which is disposed on an extension of a paper feeding path toward a paper supply destination, and which allows feeding of the paper through an underside of the movable plate.

13. The paper feeding apparatus according to claim 1, wherein the housing comprises a paper guide wall that supports and guides the papers, and wherein a relief hole for avoiding an interference with the pickup roller is provided in a portion of the paper guide wall opposed to the pickup roller;
- wherein a second friction member, having a friction resistance higher than that of the paper guide wall and lower than that of the pickup roller, is provided on the paper guide wall disposed around the relief hole; and
- wherein an engaging mechanism is disposed between the pickup lever and the housing, the engaging mechanism regulating a pivoting position of the pickup roller to prevent contact with the paper guide wall when the pickup roller is inserted into the relief hole.

14. The paper feeding apparatus according to claim 13, wherein a first friction member is provided below the relief hole.

15. The paper feeding apparatus according to claim 13, wherein the engaging mechanism has a low friction rotating portion provided in the pickup roller; and wherein the low friction rotating portion rotates in contact with the engaging mechanism.

16. A paper feeding apparatus, comprising:

a housing for accommodating a plurality of papers;

a pickup lever; and a pickup roller rotatably provided on an end of the pickup lever, the pickup roller rotating a contact surface thereof pressed against the papers to feed the papers one by one, wherein the housing comprises a paper guide wall that supports and guides the papers, and wherein a relief hole for avoiding an interference with the contact surface is provided a portion of the paper guide wall opposed to the pickup roller; and wherein an engaging mechanism is disposed between the pickup lever and the housing, the engaging mechanism comprising a stop member that regulates a pivoting position of the pickup roller to prevent contact with the paper guide wall when the contact surface is inserted into the relief hole.

17. The paper feeding apparatus according to claim 16, wherein the engaging mechanism has a low friction rotating portion provided in the pickup roller; and wherein the low friction rotating portion rotates in contact with the engaging mechanism.

18. The paper feeding apparatus according to claim 16, wherein a friction member having a friction resistance higher than that of the paper guide wall and lower than that of the contact surface, is provided on the paper guide wall disposed around the relief hole.

19. A method of feeding papers one by one to a sheet outlet of a paper housing, the method comprising:

supporting a plurality of papers in the paper housing;

selectively engaging a pickup unit with the papers, the pickup unit including a pickup lever, a driving shaft, a pickup roller, and a rotation transmitting member;

transmitting a rotating force of the driving shaft to the pickup roller with the rotation transmitting member;

selectively rotating one of the pickup lever or the pickup roller via a torque transmitting member depending on a torque acting on the driving shaft; and feeding the papers one by one from the housing to the sheet outlet by rotating the pickup roller while being pressed against the papers.

20. The method according to claim 19, wherein when the torque is smaller than a predetermined value, the method comprising rotating the pickup lever with the driving shaft, and wherein when the torque is equal to or greater than the predetermined value, the method comprising rotating the pickup roller with the driving shaft.

21. A paper feeding apparatus, operable to feed at least one sheet of paper, comprising:

a paper guide wall, adapted to support the at least one sheet of paper thereon, the guide wall having a first friction resistance and being formed with a relief hole;

a pickup roller, comprising a first outer peripheral part having a second friction resistance which is higher than the first friction resistance, and a second outer peripheral part having a third friction resistance which is lower than the second friction resistance;

a pickup lever, supporting the pickup roller at one end thereof, and being pivotable in accordance with a number of the sheets of paper supported on the paper guide wall, wherein:

the pickup lever is operable to cause the first outer peripheral part of the pickup roller to come in contact with the sheet of paper when the at least one sheet of paper is supported on the paper guide wall, so that the sheet of paper is fed in accordance with rotation of the pickup roller; and the pickup lever is operable to cause the first outer peripheral part of the pickup roller to enter the relief hole and to cause the second outer peripheral part of the pickup roller to come in contact with a first part of the paper guide wall, when no sheet of paper is supported on the guide wall.

22. The paper feeding apparatus according to claim 21, wherein a friction member having a fourth friction resistance higher than the first friction resistance and lower than the second friction resistance is provided on a second part of the paper guide wall which is different from the first part of the paper guide wall.

* * * * *